US009855743B2

(12) United States Patent
Taira et al.

(10) Patent No.: US 9,855,743 B2
(45) Date of Patent: Jan. 2, 2018

(54) INKJET RECORDING APPARATUS AND INKJET RECORDING METHOD

(71) Applicant: CANON KABUSHIKI KAISHA, Tokyo (JP)

(72) Inventors: Hiroshi Taira, Fuchu (JP); Kazuhiko Sato, Tokyo (JP); Taku Yokozawa, Yokohama (JP); Hiroaki Shirakawa, Kawasaki (JP); Mitsutoshi Nagamura, Tokyo (JP); Yuhei Oikawa, Yokohama (JP); Yosuke Ishii, Kawasaki (JP); Satoshi Azuma, Kawasaki (JP); Hiroaki Komatsu, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/279,202

(22) Filed: Sep. 28, 2016

(65) Prior Publication Data

US 2017/0087826 A1 Mar. 30, 2017

(30) Foreign Application Priority Data

Sep. 30, 2015 (JP) ..... 2015-193492

(51) Int. Cl.
*B41J 2/045* (2006.01)

(52) U.S. Cl.
CPC ..... *B41J 2/0458* (2013.01); *B41J 2/04536* (2013.01); *B41J 2/04573* (2013.01); *B41J 2/04588* (2013.01); *B41J 2/04591* (2013.01); *B41J 2/04598* (2013.01)

(58) Field of Classification Search
CPC ..... B41J 2/0458; B41J 2/045841; B41J 2/04588; B41J 2/04591; B41J 2/04598; B41J 2/04536
See application file for complete search history.

(56) References Cited

U.S. PATENT DOCUMENTS 5,581,281 A * 12/1996 Fuse ..... B41J 2/04528 347/12
5,877,785 A * 3/1999 Iwasaki ..... B41J 2/04528 347/14
6,354,687 B1 * 3/2002 Su ..... B41J 2/04536 347/12
2003/0016258 A1 * 1/2003 Anderson ..... B41J 2/04506 347/14
2003/0142159 A1 * 7/2003 Askeland ..... B41J 2/04528 347/14
2009/0002420 A1 * 1/2009 Umezawa ..... B41J 2/04536 347/14
2013/0027453 A1 * 1/2013 Fukuda ..... B41J 29/38 347/10

FOREIGN PATENT DOCUMENTS

EP 1070588 A1 * 1/2001 ..... B41J 2/04503
JP 2007-168296 A 7/2007

* cited by examiner

*Primary Examiner* — Sharon A Polk
(74) *Attorney, Agent, or Firm* — Canon USA, Inc., IP Division

(57) ABSTRACT

Recording elements are driven by changing a driving pulse applied thereto in accordance with information regarding a total number of times the recording elements have been driven.

20 Claims, 22 Drawing Sheets

FIG. 8A
| DRIVING PULSE NO. | DRIVING PULSE WAVEFORM |
|---|---|
| No.6' | 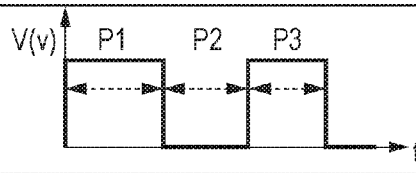  P1: 0.36 μs<br>P2: 0.30 μs<br>P3: 0.20 μs |
| No.5' | 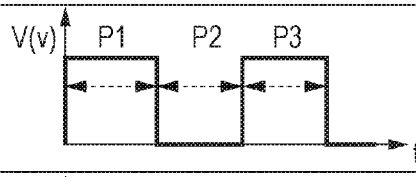  P1: 0.32 μs<br>P2: 0.30 μs<br>P3: 0.24 μs |
| No.4' | 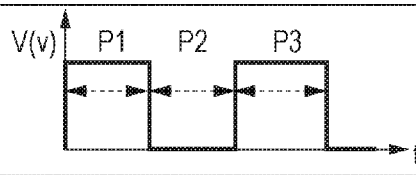  P1 :0.28 μs<br>P2 :0.30 μs<br>P3 :0.28 μs |
| No.3' | 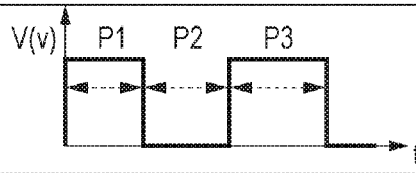  P1: 0.24 μs<br>P2: 0.30 μs<br>P3: 0.32 μs |
| No.2' | 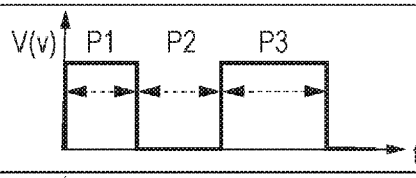  P1: 0.20 μs<br>P2: 0.30 μs<br>P3: 0.36 μs |
| No.1' | 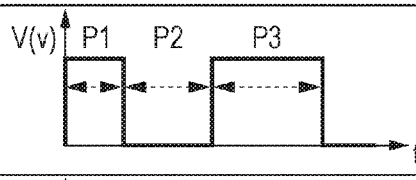  P1: 0.16 μs<br>P2: 0.30 μs<br>P3: 0.40 μs |
| No.0' | 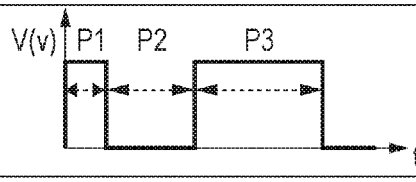  P1: 0.12 μs<br>P2: 0.30 μs<br>P3: 0.44 μs |
FIG. 8B
| INK TEMPERATURE | TEMP < 20°C | 20°C ≤ TEMP < 30°C | 30°C ≤ TEMP < 40°C | 40°C ≤ TEMP < 50°C | 50°C ≤ TEMP < 60°C | 60°C ≤ TEMP < 70°C | 70°C ≤ TEMP |
|---|---|---|---|---|---|---|---|
| DRIVING PULSE | No.6' | No.5' | No.4' | No.3' | No.2' | No.1' | No.0' |

FIG. 13A

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeA | 0.00 | 0.01 | 0.02 | 0.03 | 0.04 | 0.05 | 0.06 | 0.07 |

FIG. 13B

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeB | 0.00 | 0.00 | 0.01 | 0.01 | 0.02 | 0.02 | 0.03 | 0.03 |

FIG. 13C

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeC | 0.00 | 0.00 | 0.00 | 0.00 | 0.00 | 0.00 | 0.00 | 0.00 |

FIG. 14

| COLOR | TYPE |
|---|---|
| Bk | TypeA |
| B | TypeC |
| Gy | TypeB |
| R | TypeC |
| M | TypeC |
| Y | TypeC |
| M | TypeC |
| Cl | TypeC |

FIG. 16A

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot< 5.00E+7 | 2.50E+7 ≤Dot< 1.00E+8 | 1.00E+8 ≤Dot< 1.50E+8 | 1.50E+8 ≤Dot< 2.00E+8 | 2.00E+8 ≤Dot< 2.50E+8 | 2.50E+8 ≤Dot< 3.00E+8 | 3.00E+8 ≤Dot< 3.50E+8 | 3.50E+8 ≤Dot< 4.00E+8 |
| TypeA' | 0.00 | 0.00 | 0.00 | 0.00 | 0.01 | 0.02 | 0.03 | 0.04 |

FIG. 16B

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot< 5.00E+7 | 5.00E+7 ≤Dot< 1.00E+8 | 1.00E+8 ≤Dot< 1.50E+8 | 1.50E+8 ≤Dot< 2.00E+8 | 2.00E+8 ≤Dot< 2.50E+8 | 2.50E+8 ≤Dot< 3.00E+8 | 3.00E+8 ≤Dot< 3.50E+8 | 3.50E+8 ≤Dot< 4.00E+8 |
| TypeB' | 0.00 | 0.00 | 0.00 | 0.00 | 0.01 | 0.01 | 0.02 | 0.02 |

FIG. 16C

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot< 5.00E+7 | 5.00E+7 ≤Dot< 1.00E+8 | 1.00E+8 ≤Dot< 1.50E+8 | 1.50E+8 ≤Dot< 2.00E+8 | 2.00E+8 ≤Dot< 2.50E+8 | 2.50E+8 ≤Dot< 3.00E+8 | 3.00E+8 ≤Dot< 3.50E+8 | 3.50E+8 ≤Dot< 4.00E+8 |
| TypeC' | 0.00 | 0.00 | 0.00 | 0.00 | 0.00 | 0.00 | 0.00 | 0.00 |

FIG. 18A

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeA" | 0.00 | −0.01 | −0.02 | −0.03 | −0.04 | −0.05 | −0.06 | −0.07 |

FIG. 18B

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeB" | 0.00 | 0.00 | −0.01 | −0.01 | −0.02 | −0.02 | −0.03 | −0.03 |

FIG. 18C

| | PULSE SHIFT AMOUNT [μs] | | | | | | | |
|---|---|---|---|---|---|---|---|---|
| SECTION NO. | 0 | 1 | 2 | 3 | 4 | 5 | 6 | 7 |
| TOTAL DRIVING COUNT | 0 Dot < 5.00E+7 | 5.00E+7 ≤Dot < 1.00E+8 | 1.00E+8 ≤Dot < 1.50E+8 | 1.50E+8 ≤Dot < 2.00E+8 | 2.00E+8 ≤Dot < 2.50E+8 | 2.50E+8 ≤Dot < 3.00E+8 | 3.00E+8 ≤Dot < 3.50E+8 | 3.50E+8 ≤Dot < 4.00E+8 |
| TypeC" | 0.00 | 0.00 | 0.00 | 0.00 | 0.00 | 0.00 | 0.00 | 0.00 |

INKJET RECORDING APPARATUS AND INKJET RECORDING METHOD

BACKGROUND OF THE INVENTION

Field of the Invention

One disclosed aspect of the embodiments relates to an inkjet recording apparatus and an inkjet recording method.

Description of the Related Art

Inkjet recording apparatuses that record an image by using a recording head are known. The recording heads of such inkjet recording apparatuses includes a recording element array in which a plurality of recording elements that generate energy used to eject ink are arranged. It is generally known that a driving pulse is applied to the plurality of recording elements included in the recording head of such inkjet recording apparatuses to give thermal energy to ink and form a bubble in the ink and consequently the ink is ejected by pressure caused by the bubble.

It is also known that the longer the recording head is used, the lower the performance of the recording head becomes. Ultimately, the recording head reaches the end of its life, and the performance of the recording head sometimes degrades to an unusable level. In such a case, the recording head with the degraded performance is replaced with a new recording head. Regarding the performance degradation of the recording head, for example, Japanese Patent Laid-Open No. 2007-168296 discloses a technique in which the total number of times each of recording elements included in a recording head has been driven is counted and it is determined that the recording head has reached the end of its life if the total number of times counted for any one of the recording elements exceeds a predetermined threshold.

The technique disclosed in Japanese Patent Laid-Open No. 2007-168296 makes it possible to determine whether the recording head has reached the end of its life but fails to extend the life of the recording head. Accordingly, the frequency with which the user replaces the recording head may increase.

SUMMARY OF THE INVENTION

An embodiment has been made in view of the above issue and provides a recording technique that extends the life of the recording head.

An aspect of the embodiments provides an inkjet recording apparatus that records an image by ejecting ink onto a recording medium. The inkjet recording apparatus includes a recording head, a first obtaining unit, a determining unit, and a controller. The recording head includes a first recording element array and a second recording element array. The first recording element array includes a plurality of recording elements configured to produce thermal energy used to eject ink of a first color, and the second recording element array includes a plurality of recording elements configured to produce thermal energy used to eject ink of a second color different from the first color. The first obtaining unit obtains first information for each of the first and second recording element arrays. The first information is information regarding a total number of times the plurality of recording elements included in the corresponding one of the first and second recording element arrays have been driven since attachment of the recording head to the inkjet recording apparatus. The determining unit determines, for each of the first and second recording element arrays, a driving pulse to be applied to the plurality of recording elements included in the corresponding one of the first and second recording element arrays on the basis of the first information obtained by the first obtaining unit. The controller controls, for each of the first and second recording element arrays, driving of the plurality of recording elements included in the corresponding one of the first and second recording element arrays so as to eject the ink by applying the driving pulse determined by the determining unit to the plurality of recording elements included in the corresponding one of the first and second recording element arrays. The determining unit determines, (i-1) when the total number of times indicated by the first information for the first recording element array is a first value, a first driving pulse as the driving pulse to be applied to the first recording element array, (i-2) when the total number of times indicated by the first information for the first recording element array is a second value larger than the first value, a second driving pulse as the driving pulse to be applied to the first recording element array, the second diving pulse having a pulse width different from that of the first driving pulse, (ii-1) when the total number of times indicated by the first information for the second recording element array is the first value, a third driving pulse as the driving pulse to be applied to the second recording element array, and (ii-2) when the total number of times indicated by the first information for the second recording element array is the second value, a fourth driving pulse as the driving pulse to be applied to the second recording element array, the fourth driving pulse having a pulse width different from that of the second driving pulse and that of the third driving pulse.

Further features of the disclosure will become apparent from the following description of exemplary embodiments with reference to the attached drawings.

BRIEF DESCRIPTION OF THE DRAWINGS

FIGS. 8A and 8B are diagrams for describing general driving pulse control.

FIGS. 13A to 13C are diagrams each illustrating a pulse shift table according to the first exemplary embodiment.

FIG. 14 is a diagram indicating which pulse shift table is to be used for each recording element array in the first exemplary embodiment.

FIGS. 16A to 16C are diagrams each illustrating a pulse shift table according to a first modification.

FIGS. 18A to 18C are diagrams each illustrating a pulse shift table according to a second modification.

DESCRIPTION OF THE EMBODIMENTS

A first exemplary embodiment will be described in detail below with reference to the accompanying drawings.

First Exemplary Embodiment

Figure 1:
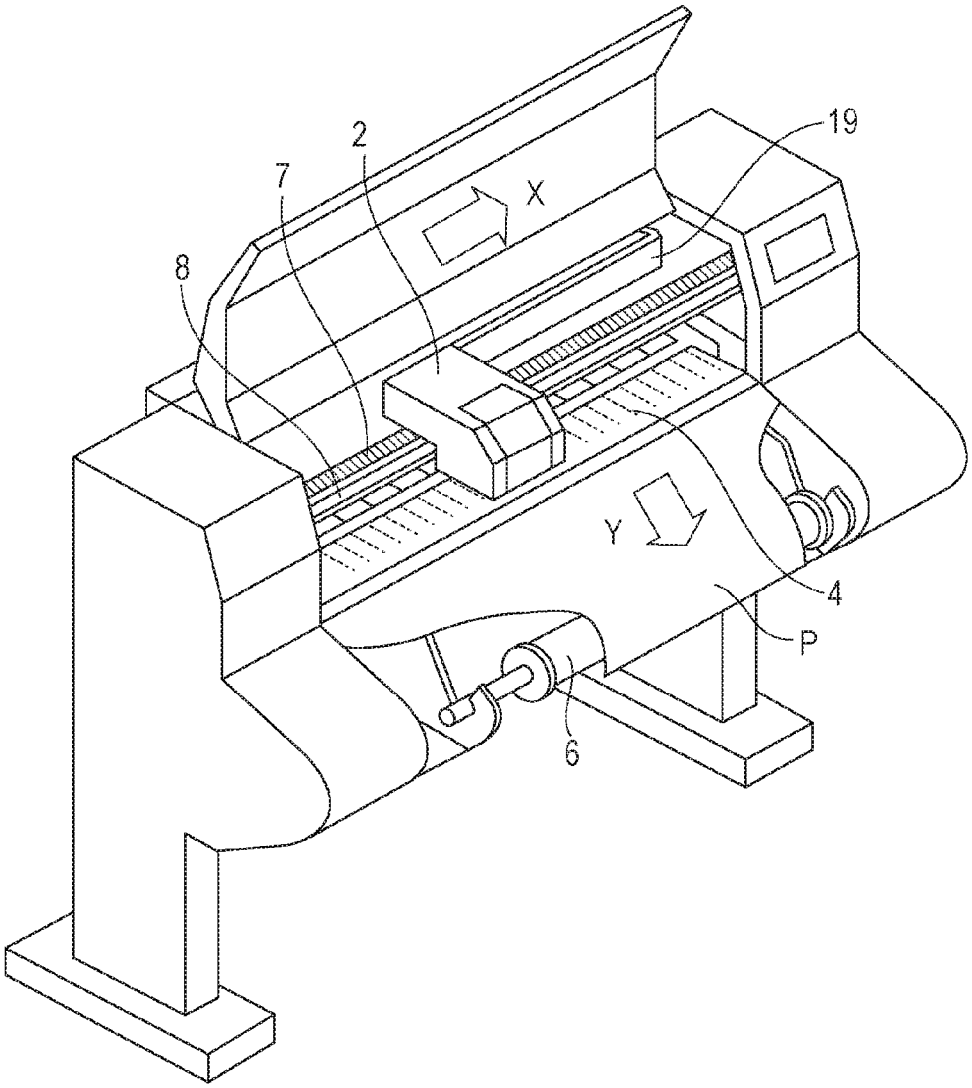
FIG. 1 is a perspective view of an inkjet recording apparatus according to a first exemplary embodiment.

FIG. 1 illustrates the appearance of an inkjet recording apparatus (hereinafter, also referred to as a printer) according to the first exemplary embodiment. The inkjet recording apparatus is a so-called serial-scan-type printer and records an image by causing a recording head to scan in a direction (X direction) perpendicular to a direction (Y direction) in which a recording medium P is conveyed.

An overview of a configuration and a recording operation of this inkjet recording apparatus will be described with reference to FIG. 1. The recording medium P is conveyed in the Y direction by a conveyance roller, which is driven by a conveyance motor (not illustrated) with a gear interposed therebetween, from a spool 6 that holds the recording medium P. A carriage motor (not illustrated) causes a carriage unit 2 to scan along a guide shaft 8, which extends in the X direction, at a predetermined conveyance position. During this scan, an ejection operation is performed at ejection ports of a recording head (described later) attachable to the carriage unit 2 at timings based on a position signal obtained by an encoder 7, and recording is performed in a band having a predetermined width corresponding to a range where the ejection ports are arranged. In the first exemplary embodiment, scanning is performed at a scan speed of 40 inches per second and the ejection operation is performed at a resolution of 600 dpi (1/600 inches). The recording medium P is then conveyed, and recording is performed for a subsequent band having the predetermined width.

Such a printer may record an image in a unit region of a recording medium in one scan (so-called single-pass recording) or in multiple scans (so-called multi-pass recording). In the case of single-pass recording, the recording medium P may be conveyed by an amount equal to the width of the band during each scan. In the case of multi-pass recording, the recording medium P is not conveyed during each scan; instead, the recording medium P may be conveyed by an amount approximately equivalent to one band relative to the unit region after the scan has been performed for the unit region of the recording medium a plurality of times. There is also another multi-pass recording method. Specifically, data is recorded after being thinned out using a predetermined mask pattern for each scan, paper is then fed by an amount approximately equivalent to a 1/n-th of a band, and the scan is then performed again. In this way, an image is completed by performing the scan and conveying operation a plurality of times (n times) in which different nozzles are used to perform recording in the unit region of the recording medium P each time.

A carriage belt can be used to transmit driving power from the carriage motor to the carriage unit 2. As an alternative to the carriage belt, another driving system, for example, a system including a leadscrew that is rotationally driven by the carriage motor and extends in the X direction and an engaging portion that is included in the carriage unit 2 and engages with a groove of the leadscrew, may be used.

The fed recording medium P is nipped and conveyed by a sheet feed roller and a pinch roller and is guided to a recording position on a platen 4 (a main scanning region of the recording head). Since a face of the recording head is usually capped in a non-operation state, the cap is removed prior to recording to prepare the recording head or the carriage unit 2 for scanning. Then, after data of one scan has been accumulated in a buffer, the carriage motor causes the carriage unit 2 to scan to perform recording in the above-described manner.

The recording head is connected to one of terminals of a flexible wiring substrate 19 used to supply signals, such as a driving pulse for ejection driving and a head temperature adjustment signal. The other terminal of the flexible wiring substrate 19 is connected to a controller (not illustrated) including control circuitry, such as a central processing unit (CPU) that controls the printer. In addition, a thermistor (not illustrated), which is a temperature sensor that detects an ambient temperature in the inkjet recording apparatus, is also provided in the vicinity of the controller.

Figure 2:
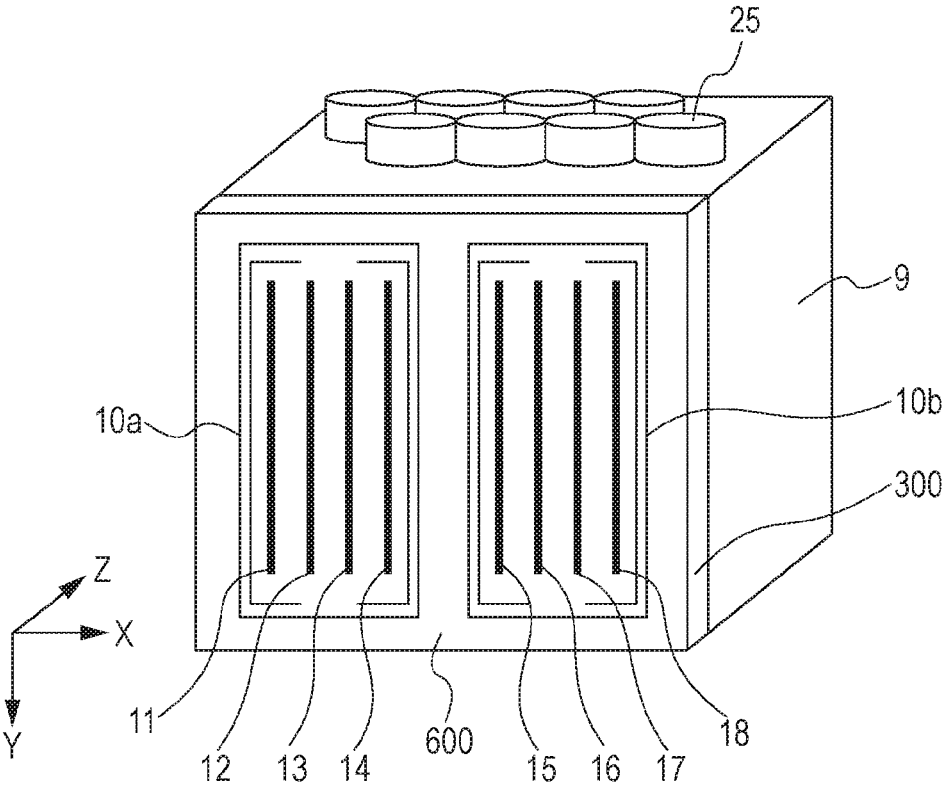
FIG. 2 is a schematic view of a recording head according to the first exemplary embodiment.

FIG. 2 is a perspective view schematically illustrating a recording head 9 according to the first exemplary embodiment.

The recording head 9 includes a joint portion 25. An ink supply tube is connected to the joint portion 25.

Two recording element substrates 10*a* and 10*b* formed of semiconductors and the like are attached to an ejection port surface, which is a surface of the recording head 9 that opposes the recording medium P. Each of the recording element substrates 10*a* and 10*b* includes ejection port arrays extending in a Y direction perpendicular to an X direction. Specifically, the recording element substrate 10*a* includes an ejection port array 11 from which black (Bk) ink is ejected, an ejection port array 12 from which cyan (C) ink is ejected, an ejection port array 13 from which magenta (M) ink is ejected, and an ejection port array 14 from which yellow (Y) ink is ejected. The ejection port arrays 11 to 14 are arranged side by side in the X direction. The recording element substrate 10*b* includes an ejection port array 15 from which gray (G) ink is ejected, an ejection port array 16 from which red (R) ink is ejected, an ejection port array 17 from which blue (B) ink is ejected, and an ejection port array 18 from which clear (Cl) ink is ejected. The ejection port arrays 15 to 18 are arranged side by side in the X direction.

Each of the cyan ink, the magenta ink, the yellow ink, the red ink, and the blue ink contains a pigment of the color as its colorant. Each of the black ink and the gray ink contains carbon black, which is a black pigment, as its colorant. The concentration of carbon black in the grey ink is adjusted to be lower than the concentration of carbon black in the black ink. The clear ink is ink for improving an image characteristic of the color inks when being applied on the layers of the color inks on the recording medium and contains no colorant.

As described below, recording element arrays are disposed at positions on the recording element substrates 10*a* and 10*b* opposing the respective ejection port arrays 11 to 18. For ease of explanation, the recording element arrays disposed at positions opposing the ejection port arrays 11 to 18 are referred to as recording element arrays 11*x* to 18*x*, respectively.

The recording element substrates 10*a* and 10*b* are fixed to a support member 300, composed of alumina, resin, or the like, by an adhesive. The recording element substrates 10*a* and 10*b* are electrically connected to an electric wiring member 600 having wirings and communicate with the recording head 9 via the electric wiring member 600 by using a signal.

Figure 3A:
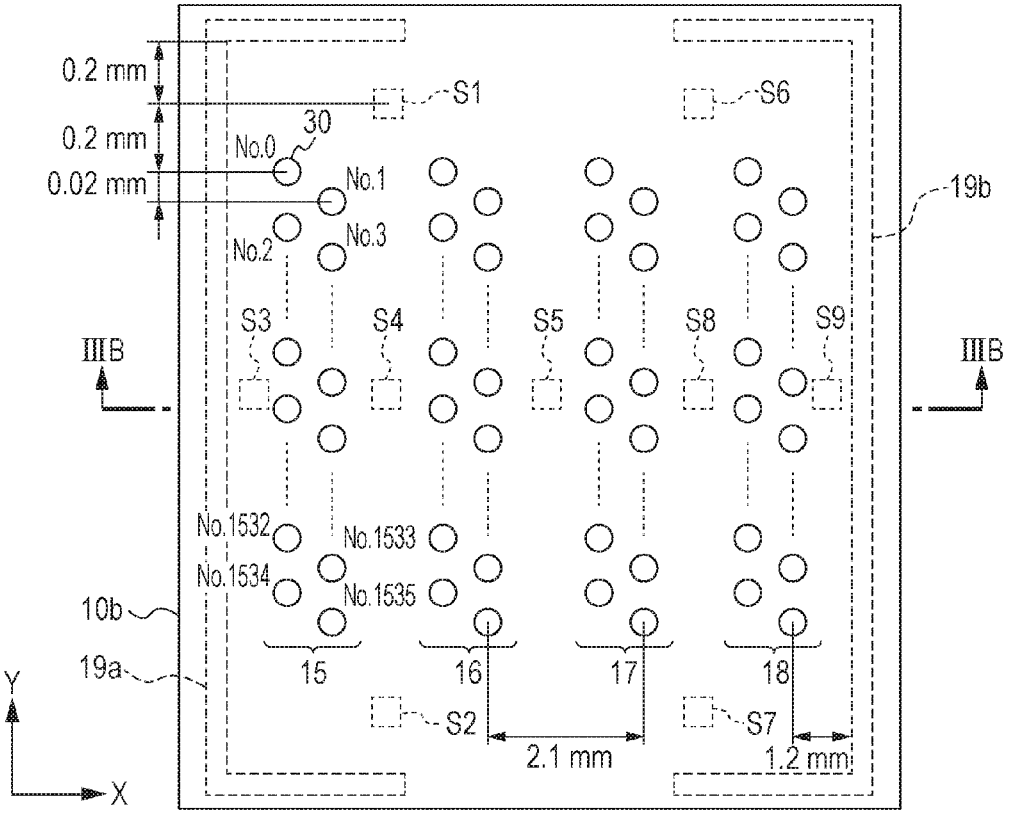
FIGS. 3A to 3C are perspective and cross-sectional views of the recording head according to the first exemplary embodiment.
Figure 3B:
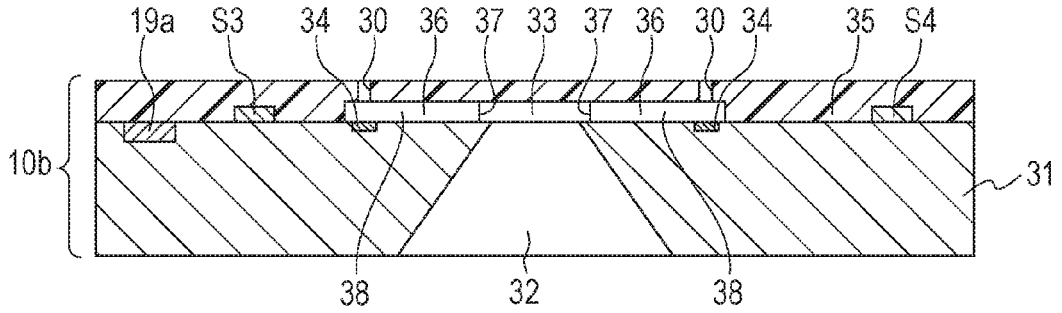
Figure 3C:
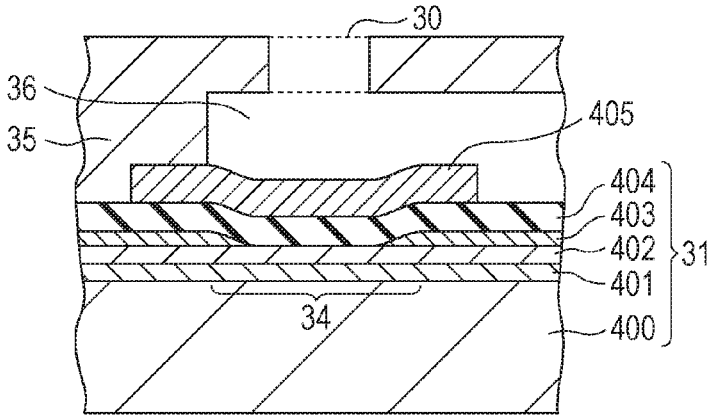

FIG. 3A is a perspective view obtained when the recording element substrate 10*b* is viewed from a direction perpendicular to the X-Y plane. FIG. 3B is a cross-sectional view taken along line IIIB-IIIB illustrated in FIG. 3A and obtained when a cross-sectional portion of the recording element substrate 10*b* near the ejection port array 15 is viewed from a downstream side in the Y direction. FIGS. 3A and 3B illustrate the individual components at a dimension ratio different from the actual dimension ratio for ease of illustration. The actual dimensions of the recording element substrate 10*b* are 9.55 mm in the X direction and 39.0 mm in the Y direction. In addition, FIG. 3C is a partially enlarged view of a recording element 34.

Each of the ejection port arrays 11 to 18 according to the first exemplary embodiment includes two lines of ejection ports. Each of the two lines includes 768 ejection ports 30, which are arranged in the Y direction (arrangement direction) in the opposing lines with shifted from each other by one dot at 1200 dpi (dots/inch). In this way, 1536 ejection ports 30 and 1536 recording elements 34 (also referred to as main heaters), which are electro-thermal conversion elements, opposing the ejection ports 30 are arranged in the Y direction (predetermined direction). Note that, in the first exemplary embodiment, 1200 dpi is equivalent to approximately 0.02 mm. Thermal energy used to eject ink from the ejection ports 30 can be produced by applying a driving pulse to the recording elements 34. Although the case of using electro-thermal conversion elements as the recording elements 34 has been described, piezoelectric elements or the like may be used as the recording elements 34.

For ease of explanation, the ejection port 30 and the recording element 34 located on the most downstream side in the Y direction, among the 1536 ejection ports 30 and the 1536 recording elements 34, are collectively assigned No. 0. In addition, the ejection port 30 and the recording element 34 located on the immediately upstream side of the pair No. 0 in the Y direction is assigned No. 1. Likewise, No. 2 to No. 1534 are assigned. The ejection port 30 and the recording element 34 located on the most upstream side in the Y direction are collectively assigned No. 1535.

The recording element substrate 10*b* includes nine diode sensors S1 to S9, which serve as temperature sensors that detect ink temperature near the respective recording elements 34.

Two diode sensors S1 and S6, among the diode sensors S1 to S9, are disposed near one of ends of the ejection port arrays 15 to 18 in the Y direction. Specifically, the diode sensors S1 and S6 are disposed to be spaced apart from the ejection ports 30 located at one end in the Y direction by 0.2 mm. The diode sensor S1 is disposed between the ejection port arrays 15 and 16 in the X direction, and the diode sensor S6 is disposed between the ejection port arrays 17 and 18 in the X direction.

Two diode sensors S2 and S7 are disposed near the other ends of the ejection port arrays 15 to 18 in the Y direction. The diode sensor S2 is disposed between the ejection port arrays 15 and 16 in the X direction, and the diode sensor S7 is disposed between the ejection port arrays 17 and 18 in the X direction. Specifically, the diode sensors S2 and S7 are disposed to be spaced apart from the ejection ports 30 at the other end in the Y direction by 0.2 mm.

Further, five diode sensors S3, S4, S5, S8, and S9 are disposed at the middle part of the ejection port arrays 15 and 18 in the Y direction. The diode sensor S4 is disposed between the ejection port arrays 15 and 16 in the X direction. The diode sensor S5 is disposed between the ejection port arrays 16 and 17 in the X direction. The diode sensor S8 is disposed between the ejection port arrays 17 and 18 in the X direction. The diode sensor S3 is disposed on the outer side of the ejection port array 15 in the X direction. The diode sensor S9 is disposed on the outer side of the ejection port array 18 in the X direction.

In the first exemplary embodiment, the temperature of the recording element substrate 10*b* is treated as the temperature of ink because the temperature of the ink in the ejection port 30 near each of the diode sensors S1 to S9 is substantially equal to the temperature of the recording element substrate 10*b* at the position where the diode sensor is disposed.

The recording element substrate 10*b* includes heating elements (hereinafter, also referred to as sub-heaters) 19*a* and 19*b* that heat the ink in the ejection ports 30 to increase the temperature. The heating element 19*a* is formed of a continuous member such that the ejection port array 15 is surrounded by the heating element 19*a* from the side where the diode sensor S3 is disposed in the X direction. Likewise, the heating element 19*b* is formed of a continuous member such that the ejection port array 18 is surrounded by the heating element 19*b* from the side where the diode sensor S9 is disposed in the X direction. Note that the heating elements 19*a* and 19*b* are spaced apart from the ejection port arrays 15 and 18 by 1.2 mm on the outer side of the ejection port arrays 15 and 18 in the X direction, respectively, and are spaced apart from the diode sensors S1, S2, S6, and S7 by 0.2 mm on the outer side of the diode sensors S1, S2, S6, and S7.

The recording element substrate 10*b* includes a substrate 31 including various circuits disposed thereon and an ejection port member 35 composed of a resin as well as the diode sensors S1 to S9 and the sub-heaters 19*a* and 19*b*. A common ink chamber 33 is disposed between the substrate 31 and the ejection port member 35. The common ink chamber 33 communicates with an ink supply port 32. An ink channel 36 extends from the common ink chamber 33. The ink channel 36 communicates with the ejection port 30 formed in the ejection port member 35. The ink channel 36 includes a bubble formation chamber 38 at its end portion near the ejection port 30. The bubble formation chamber 38 includes the recording element (main heater) 34 at a position opposing the ejection port 30. In addition, a nozzle filter 37 is disposed between the ink channel 36 and the common ink chamber 33.

As illustrated in FIG. 3C, a heat accumulation layer 401, a heating material layer 402, and a pair of electrode layers 403 are stacked on a substrate 400 composed of silicon and including driving elements, such as transistors, thereon. The heat accumulation layer 401 can be formed using an insulating material mainly composed of silicon. The heating material layer 402 can be formed using a material, such as TaSiN, that produces heat when being supplied with electric power. The pair of electrode layers 403 can be formed using aluminum or the like serving as an electrode to which electric power is supplied. The heating material layer 402 located between the pair of electrode layers 403 is used as the recording element 34.

An insulating layer 404 formed using an insulating material mainly composed of silicon is stacked on the heating material layer 402 and the pair of electrode layers 403 to protect the recording element 34 from ink or the like. Further, a protection layer 405 formed using a metal material, such as Ta, is disposed on a portion of the insulating layer 404 corresponding to the recording element 34 in order to protect the recording element 34 from cavitation caused when a bubble vanishes.

The ink supplied to the recording head 9 through the joint portion 25 from the ink supply channel of the inkjet recording apparatus is transported to the ink supply port 32 of the recording element substrate 10*b* through an ink channel (not illustrated) formed in the support member 300 inside the recording head 9. The ink is then transported to the upper side of the recording element 34 through the ink channel 36.

A driving pulse determined in a manner described later is applied to the recording element 34 in accordance with recording data received from the inkjet recording apparatus, whereby the recording element 34 is driven and produces heat. The resulting thermal energy causes the ink on the recording element 34 to start film boiling, that is, changes the state of the ink to form a bubble. The ink is ejected from the ejection port 30 by pressure of the bubble thus formed. In this way, a recording operation is performed.

Although the recording element substrate 10*b* has been described in detail here, the recording element substrate 10*a* also has a similar configuration.

In the first exemplary embodiment, a representative temperature is calculated for each of the recording element arrays 15*x* to 18*x* on the basis of a temperature detected by a different combination of diode sensors from among the diode sensors S1 to S9, and driving pulse control (described later) is performed on the basis of the representative temperature calculated for each recording element array. Specifically, when driving pulse control is performed for the recording element array 15*x*, the average of temperatures detected by four diode sensors S1, S2, S3, and S4 that surround the recording element array 15*x* is set as the representative temperature. When driving pulse control is performed for the recording element array 16*x*, the average of temperatures detected by four diode sensors S1, S2, S4, and S5 that surround the recording element array 16*x* is set as the representative temperature. When driving pulse control is performed for the recording element array 17*x*, the average of temperatures detected by four diode sensors S5, S6, S7, and S8 that surround the recording element array 17*x* is set as the representative temperature. When driving pulse control is performed for the recording element array 18*x*, the average of temperatures detected by four diode sensors S6, S7, S8, and S9 that surround the recording element array 18*x* is set as the representative temperature.

Note that the representative temperature calculation method is not limited to the above method. For example, the representative temperature may be calculated by using the largest value of the temperatures detected by four diode sensors that surround each of the recording element arrays 15*x* to 18*x*. Alternatively, the representative temperature may be calculated for each of the recording element arrays 15*x* to 18*x* by using an average of the temperatures detected by the nine diode sensors S1 to S9 included in the recording element substrate 10*b*. Further, the recording head 9 need not include a plurality of diode sensors in the first exemplary embodiment unlike FIG. 3A and is just required to include at least one diode sensor.

Figure 4:
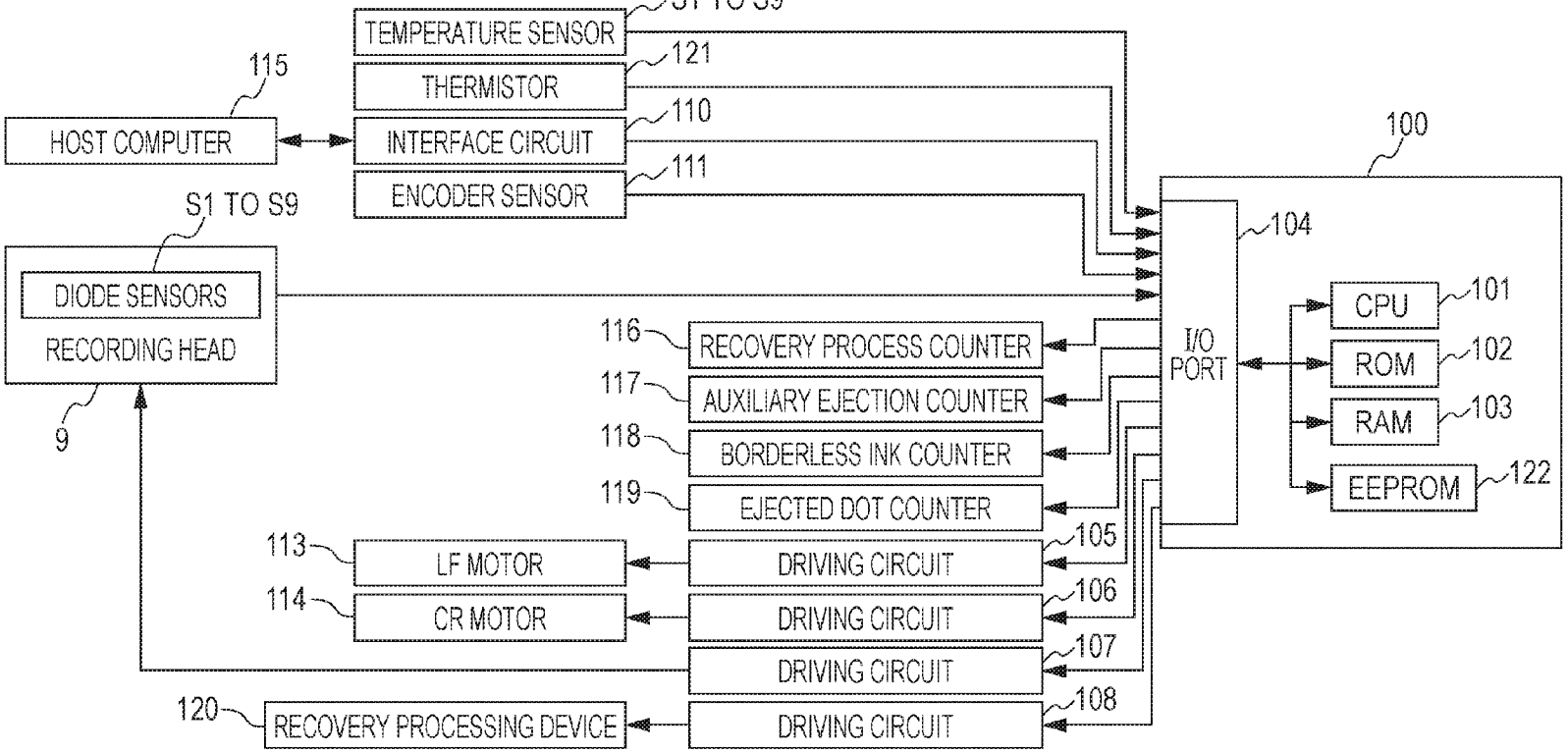
FIG. 4 is a diagram illustrating a recording control system according to the first exemplary embodiment.

FIG. 4 is a block diagram illustrating a configuration of a control system installed in the inkjet recording apparatus according to the first exemplary embodiment. A main controller 100 includes a CPU 101 that performs processing operations, such as computation, control, determination, and setup. The main controller 100 also includes a read-only memory (ROM) 102, a random access memory (RAM) 103, and an input/output (I/O) port 104. The ROM 102 functions as a memory that stores a control program and other programs to be executed by the CPU 101. The RAM 103 is used as a buffer that stores binary recording data indicating whether to eject ink and as a workspace during processing performed by the CPU 101. The RAM 103 is also used as a memory that stores information regarding an amount of ink remaining in a main tank before and after a recording operation and a free space in a sub-tank. A conveyance motor (LF motor) 113 that drives the conveyance roller, a carriage motor (CR motor) 114, and various driving circuits 105, 106, 107, and 108 that drive the recording head 9, a recovery processing device 120, and so on are connected to the I/O port 104. These driving circuits 105, 106, 107, and 108 are controlled by the main controller 100. Various sensors, such as the diode sensors S1 to S9 that detect temperature of the recording head 9, an encoder sensor 111 fixed to the carriage unit 2, and a thermistor 121 that detects ambient temperature (environment temperature) in the inkjet recording apparatus are connected to the I/O port 104. The main controller 100 is connected to a host computer 115 via an interface circuit 110.

The driving circuit 107, which functions as a signal transmission unit, transmits a driving pulse to be applied and recording data used for recording to the recording head 9. The driving pulse and the recording data are transmitted via the flexible wiring substrate 19 described above.

A recovery processing counter 116 counts the number of times the recording elements have been driven during a so-called recovery process in which ink is compulsorily ejected from the recording head 9 by the recovery processing device 120. An auxiliary ejection counter 117 counts the number of times the recording elements have been driven for auxiliary ejection that is performed before recording is started, during recording, and after recording is finished. A borderless ink counter 118 counts the number of times the recording elements have been driven when ink is ejected to outside of the recording region of the recording medium during borderless recording. An ejected dot counter 119 counts the number of times the recording elements have been driven during recording.

The sum of the counted values obtained by these counters 116 to 119 is stored in an electrically erasable programmable ROM (EEPROM) 122 as a total number of times the recording elements included in each recording element array have been driven (hereinafter, referred to as a total driving count) since attachment of the recording head 9 to the inkjet recording apparatus. Note that the total driving count of the recording elements is calculated for each recording element array in the first exemplary embodiment.

The EEPROM 122 is capable of storing various kinds of information in addition to the total driving counts of the recording elements.

Figure 5:
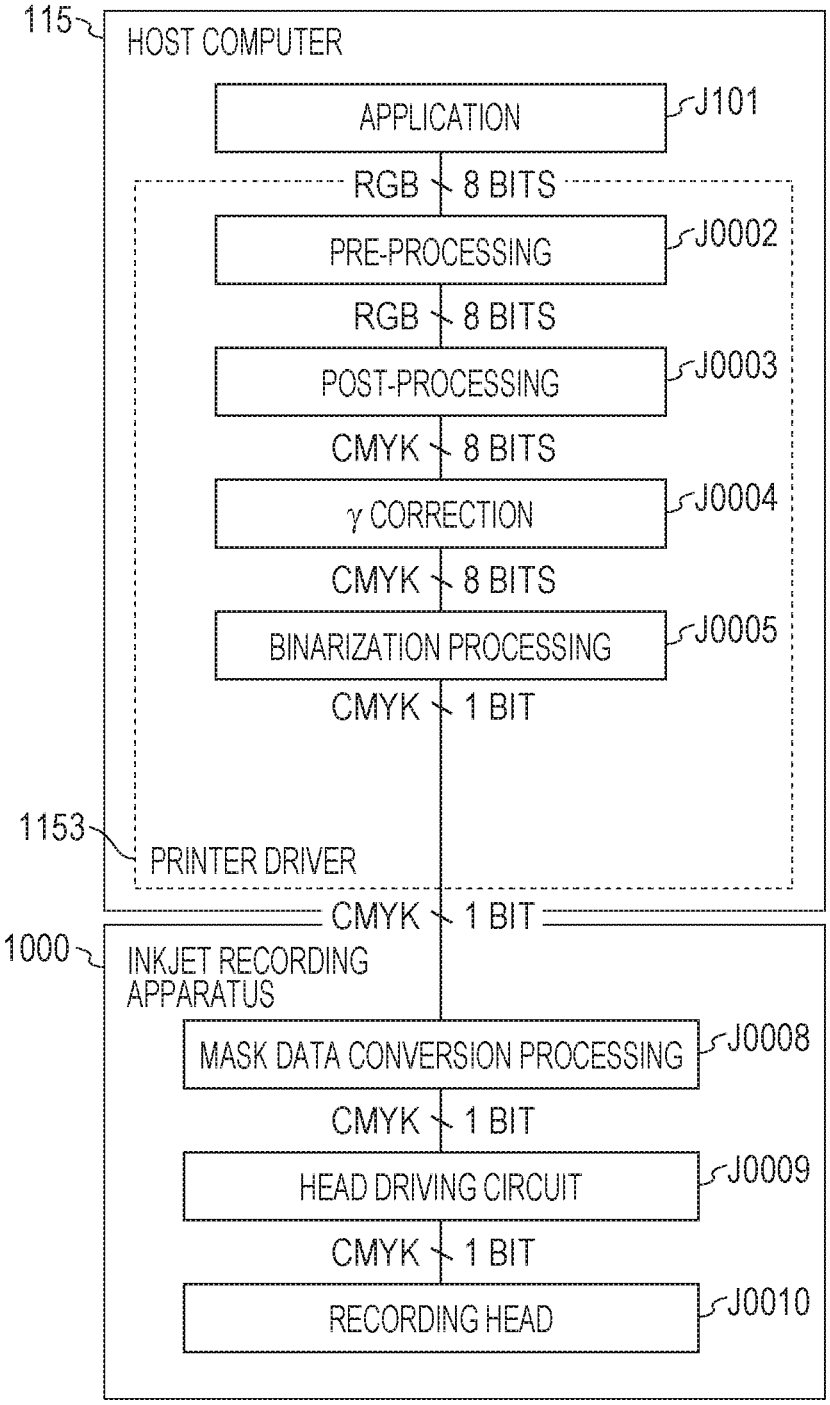
FIG. 5 is a diagram illustrating a data processing process according to the first exemplary embodiment.

FIG. 5 is a flowchart describing an image data processing process according to the first exemplary embodiment.

Image data to be recorded by an inkjet recording apparatus 1000 is created by using an application J101 of the host computer 115. When recording is performed, the image data created by using the application J101 is transferred to a printer driver 1153. The printer driver 1153 performs pre-processing J0002, post-processing J0003, γ correction J0004, and binarization processing J0005 on the created image data.

During the pre-processing J0002, color gamut conversion is performed to convert a color gamut of a display of the host computer 115 to a color gamut of the inkjet recording apparatus 1000. Specifically, image data (R, G, B) in which R, G, and B each represented using 8 bits are converted into 8-bit data (R, G, B) in the color gamut of the inkjet recording apparatus 1000 by using a three-dimensional lookup table.

During the post-processing J0003, the color that reproduces the converted color gamut is separated into a color gamut of inks. Specifically, processing is performed to determine 8-bit data (image data) corresponding to a combination of inks used to reproduce the color represented by the 8-bit data (R, G, B) in the color gamut of the inkjet recording apparatus 1000 obtained by the pre-processing J0002.

During the γ correction J0004, γ correction is performed on each 8-bit data (image data) obtained by the color separation. A conversion is performed such that each 8-bit data obtained by the post-processing J0003 is linearly associated with a gradation characteristic of the inkjet recording apparatus 1000 to determine 8-bit data (correction data) corresponding to the combination of inks.

During the binarization processing J0005, binarization processing is performed in which each 8-bit data (correction data) obtained by the γ correction J0004 is converted into 1-bit data and binary data is generated. A density pattern method, a dithering method, an error diffusion method, or the like is suitably used as the binarization method.

The data thus generated is supplied to the inkjet recording apparatus 1000. During mask data conversion processing J0008, the supplied data is converted into recording data indicating whether to eject ink, by using the binary data created by the binarization processing J0005 and a mask pattern stored on the ROM 102. This mask pattern is created by arranging recording-permitted pixels for which ejection of ink is permitted and non-recording-permitted pixels for which ejection of ink is not permitted in a specific pattern. Note that the mask pattern used during the mask data conversion processing J0008 is stored on a predetermined memory in the inkjet recording apparatus 1000 in advance. For example, the mask pattern may be stored on the ROM 102 described above, and the supplied data may be converted into the recording data by the CPU 101 by using this mask pattern.

The recording data obtained by the mask data conversion processing J0008 is supplied to the head driving circuit 107 (J0009) and the recording head 9 (J0010). In accordance with this recording data, inks are ejected onto the recording medium P from the respective ejection ports 30 arranged in the recording head 9.

Driving of the motors, the recording head 9, and other components is controlled on the basis of the recording data created through the various kinds of processing described above and a recording operation is performed.

General Driving Pulse Control

During so-called driving pulse control, one driving pulse is selected from among a plurality of driving pulses in accordance with ink temperature during a recording operation and is applied to the recording elements 34 to cause the recording elements 34 to produce heat, and ink is ejected by using the resulting thermal energy. A generic example of such driving pulse control will be described in detail below.

In the first exemplary embodiment, a so-called double pulse including a pre-pulse and a main pulse is used as a driving pulse to be applied.

Figure 7:
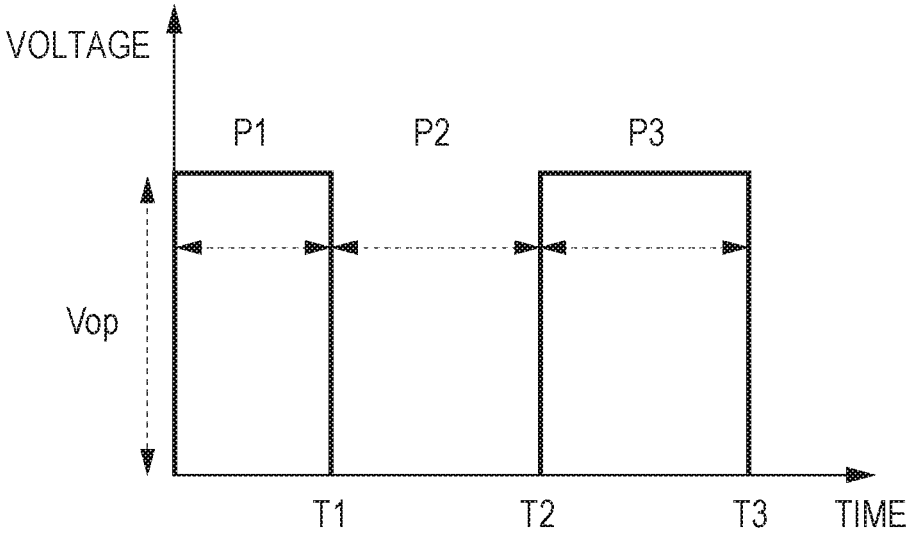
FIG. 7 is a diagram illustrating a driving pulse.

FIG. 7 is a diagram illustrating the aforementioned double pulse. In FIG. 7, Vop denotes a driving voltage, P1 denotes a pulse width of the pre-pulse, P2 denotes a time interval, and P3 denotes a pulse width of the main pulse. Since ink ejection control is performed by controlling the pulse width P1 of the pre-pulse, the pre-pulse plays an important role.

The pre-pulse is a pulse to be applied mainly in order to increase ink temperature near the recording elements to cause bubble formation more easily. The pulse width P1 of the pre-pulse is set to a value smaller than or equal to a pulse width that produces energy smaller than energy at a boundary where a bubble is formed in the ink.

The time interval P2 is a predetermined time period provided between the pre-pulse and the main-pulse. The time interval P2 is set such that heat produced by application of the pre-pulse is sufficiently transferred to ink near the recording elements. The main pulse is a pulse used to form a bubble in the ink and eject an ink droplet.

Figure 6A:
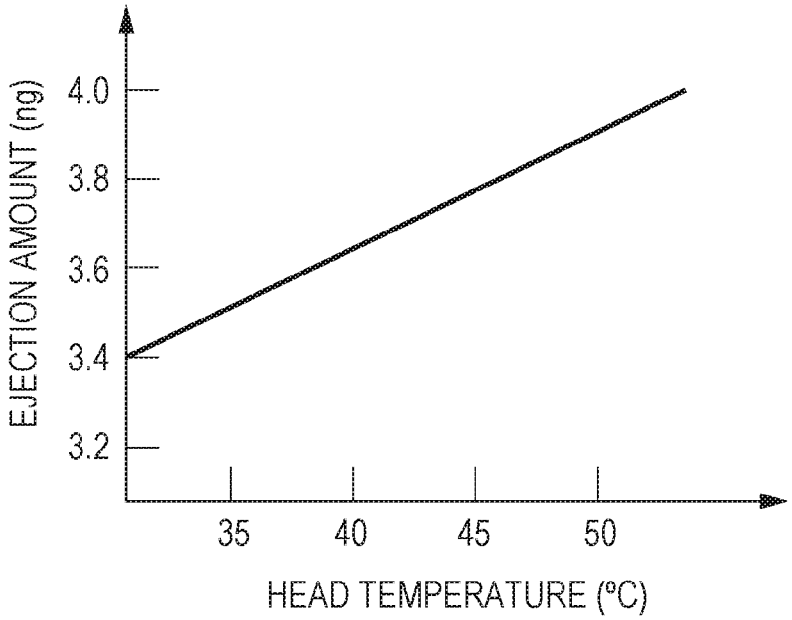
FIGS. 6A and 6B are diagrams illustrating a correlation between ink temperature and an amount of ejected ink and a correlation between a driving pulse and an amount of ejected ink.

FIG. 6A is a diagram illustrating a relationship between ink temperature and an amount of ejected ink in the case where the waveform of the driving pulse to be applied to the recording element 34 and the driving voltage Vop are fixed. FIG. 6A indicates that the amount of ejected ink increases as the ink temperature increases.

Figure 6B:
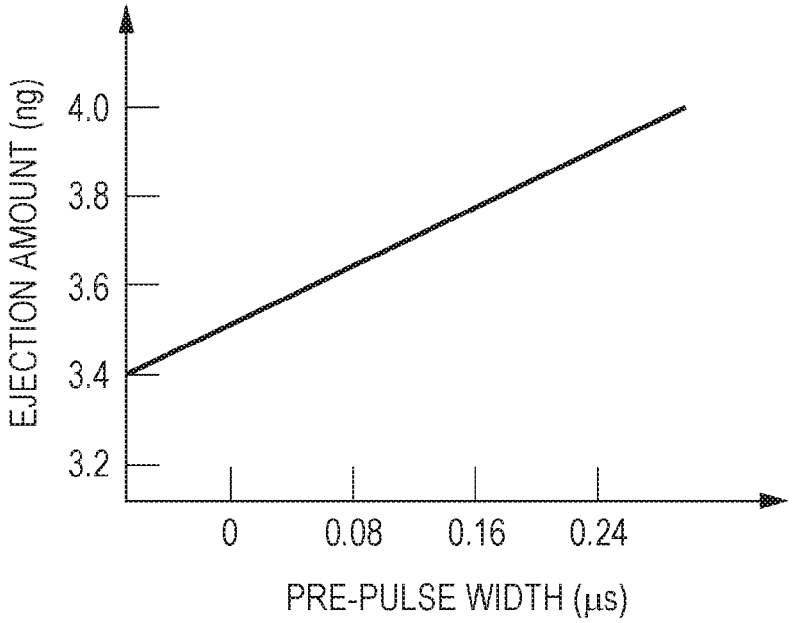

FIG. 6B is a diagram illustrating a relationship between the pulse width P1 of the pre-pulse and the amount of ejected ink in the case where the time interval P2, the driving voltage Vop, and the ink temperature are fixed. FIG. 6B indicates that the amount of ejected ink increases in proportion to an increase in the pulse width P1 of the pre-pulse. As the pulse width P1 of the pre-pulse increases, that is, as the amount of energy produced by the pre-pulse increase, the ink temperature increases. As the ink temperature increases, ink viscosity decreases. If the main pulse is applied when the ink viscosity is low, the amount of ejected ink increases. Conversely, if the main pulse is applied when the ink viscosity is not low enough, the amount of ejected ink decreases.

Accordingly, during general driving pulse control, a variation in the amount of ejected ink caused by a change in substrate temperature (ink temperature) is suppressed by changing the pulse width P1 of the pre-pulse in accordance with the ink temperature. Specifically, when the ink temperature is relatively low, the amount of ejected ink may decrease. Thus, the pulse width P1 of the pre-pulse of the driving pulse applied to the recording element 34 is set to a relatively large value. In this way, the decrease in the amount of ejected ink is successfully suppressed. Likewise, when the ink temperature is relatively high, the pulse width P1 of the pre-pulse is set to a relatively small value.

FIG. 8A is a diagram illustrating waveforms of a plurality of driving pulses in which the pulse width P1 of the pre-pulse is different.

Seven driving pulses No. 0' to No. 6' have an equal driving voltage. In addition, the driving pulses No. 0' to No. 6' have an equal time interval P2 (P2=0.30 μs). However, the driving pulses No. 0' to No. 6' are configured such that the pre-pulse has different pulse width P1 and the main pulse has different pulse width P3.

Specifically, the driving pulse No. 0' is configured such that the pre-pulse has the shortest pulse width P1 (P1=0.12

μs) and the main pulse has the longest pulse width P3 (P3=0.44 μs) among the seven driving pulses.

The driving pulse No. 1' is configured such that the pulse width P1 of the pre-pulse is longer than that of the driving pulse No. 0' by 0.04 μs (P1=0.16 μs) and the pulse width P3 of the main pulse is shorter than that of the driving pulse No. 0' by 0.04 μs (P3=0.40 μs).

Likewise, as the number assigned to the driving pulse increases by one, the pulse width P1 of the pre-pulse increases by 0.04 μs and the pulse width P3 of the main pulse decreases by 0.04 μs.

The driving pulse No. 6', which is assigned the largest number among the seven driving pulses, is configured such that the pre-pulse has the longest pulse width P1 (P1=0.36 μs) among the seven driving pulses and the main pulse has the shortest pulse width P3 (P3=0.20 μs) among the seven driving pulses.

As illustrated in FIG. 6B, the amount of ejected ink increases as the pulse width P1 of the pre-pulse increases. Accordingly, when the driving pulses No. 0' to No. 6' illustrated in FIG. 8A are applied to the recording element 34 in the same ink temperature condition, the amount of ejected ink is the smallest when the driving pulse No. 0' is applied and is the largest when the driving pulse No. 6' is applied. The pulse width P1 of the pre-pulse equally increases by 0.04 μs as the number assigned to the driving pulses No. 0' to No. 6' increases. Accordingly, the amount of ejected ink also equally increases as the number assigned to the driving pulses increases.

FIG. 8B is a diagram illustrating a driving pulse table of a correspondence between the ink temperature and the driving pulse actually applied to the recording element 34.

As described above, the amount of ejected ink increases as the ink temperature increases. To suppress a variation in the amount of ejected ink caused by such a variation in the ink temperature, a driving pulse including the pre-pulse having a smaller pulse width P1 is selected and applied for a higher ink temperature.

For example, as illustrated in FIG. 8B, when the ink temperature is relatively low, i.e., lower than 20° C., the driving pulse No. 6' including the pre-pulse having a relatively large pulse width P1 illustrated in FIG. 8A is selected. In contrast, when the ink temperature is relatively high, i.e., higher than 70° C., the driving pulse No. 0' including the pre-pulse having a relatively small pulse width P1 illustrated in FIG. 8A is selected.

Figure 9:
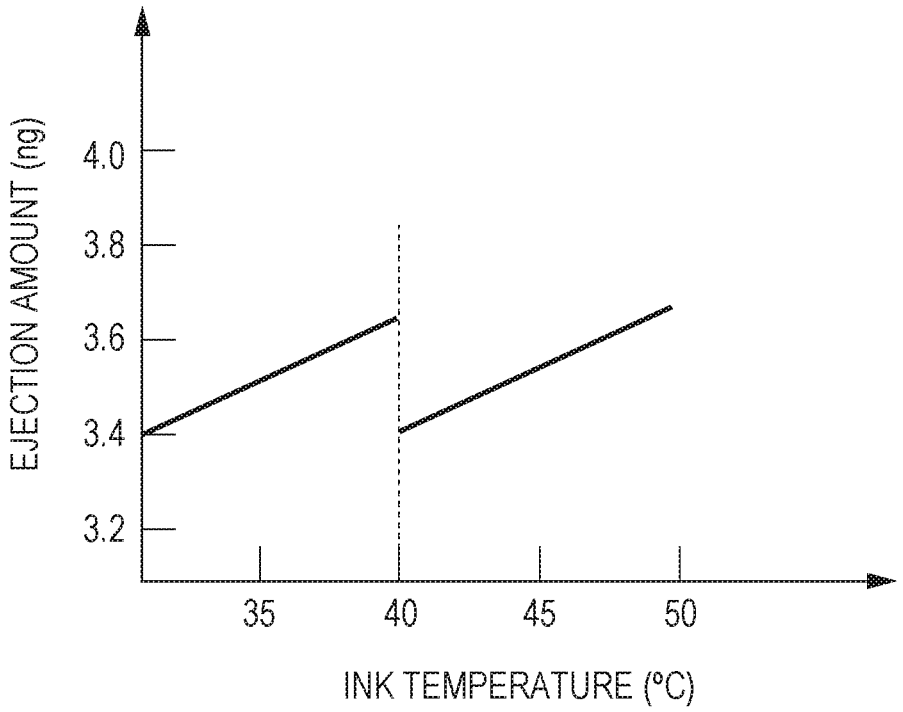
FIG. 9 is a diagram illustrating a correlation between temperature and an amount of ejected ink obtained when driving pulse control is performed.

FIG. 9 is a diagram illustrating a correlation between the ink temperature and the amount of ejected ink in the case where the driving pulse is selected and applied in a manner illustrated in FIGS. 8A and 8B.

As indicated by FIG. 8B, the driving pulse No. 4' is applied to the recording element 34 in a temperature range from 30° C. to 40° C. of the temperature range illustrated in FIG. 9. In this period, the amount of ejected ink increases as the ink temperature increases, just like the case illustrated in FIG. 6A.

After the ink temperature exceeds 40° C., the applied driving pulse is changed to the driving pulse No. 3' including the pre-pulse having a shorter pulse width P1 than the pre-pulse of the driving pulse No. 4'. Accordingly, an increase in the amount of ejected ink is successfully suppressed as indicated by FIG. 9. Recording can be performed while successfully suppressing a variation in the amount of ejected ink by performing driving pulse control in this way even if the ink temperature varies.

Suppressing Performance Degradation of Recording Elements in Response to Increase in Driving Count An investigation made by the inventors indicates that the life of the recording element used in the first exemplary embodiment shortens in the following manner. Depending on the type of ink used, the surface of the recording element wears as a result of driving, and the recording element is damaged as a result of the same region of the recording element wearing many times as the number of times the recording element has been driven increases.

It is experimentally confirmed that the aforementioned phenomenon occurs particularly for ink containing carbon black, i.e., black ink and gray ink. Further, the damage is caused in the recording element due to the aforementioned phenomenon more markedly for black ink than for gray ink.

Figure 10A:
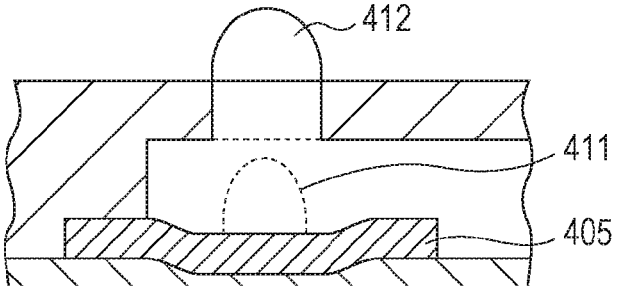
FIGS. 10A to 10C are schematic views for describing how a recording element wears as the driving count increases.
Figure 10B:
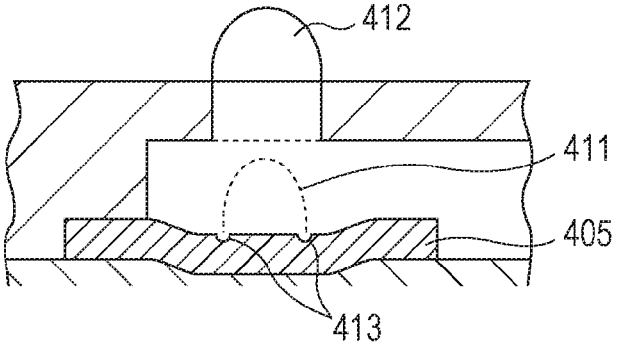
Figure 10C:
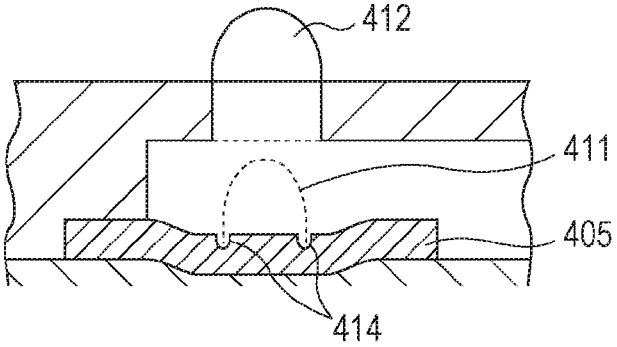

FIGS. 10A to 10C are schematic views for describing an estimated mechanism how the aforementioned phenomenon is caused. FIG. 10A is a diagram illustrating a portion near the recording element 34 when an ink droplet is ejected immediately after driving of the recording element 34 has been started. FIG. 10B is a diagram illustrating the portion near the recording element 34 when ink is ejected after the driving count has increased from the state illustrated in FIG. 10A. FIG. 10C is a diagram illustrating the portion near the recording element 34 when the ink is ejected after the driving count has further increased from the state illustrated in FIG. 10B.

As described above, in the first exemplary embodiment, a driving pulse is applied to the recording element 34 to form a bubble 411, and an ink droplet 412 is ejected by pressure of the bubble 411. In the case where ink contains relatively hard pigment particles such as carbon black, the protection layer 405 that is in contact with an interface between the ink and the bubble 411 wears. Thus, the protection layer 405 that is in contact with the interface between the ink and the bubble 411 comes to have wear 413 as the driving count of the recording element 34 increases as illustrated in FIG. 10B.

The size of the bubble 411 depends on driving energy applied to the recording element 34, and the driving energy changes in accordance with the driving voltage and the pulse width P3 of the main pulse of the driving pulse applied to the recording element 34. Specifically, the longer the pulse width P3 of the main pulse of the driving pulse and the higher the driving voltage, the larger the formed bubble 411.

Accordingly, if the same driving pulse is always applied to the recording element 34, the bubble of the same size is formed substantially always. Since the bubble 411 is formed such that the interface between the ink and the bubble 411 is in contact with the protection layer 405 at the same position regardless of the increase in the driving count, the wear 413 illustrated in FIG. 10B deepens as the driving count further increases. Consequently, deep wear 414 is formed as illustrated in FIG. 10C. It is considered that this wear 414 is the main factor that shortens the life of the recording element 34.

It is experimentally confirmed that the wear 413 occurs more markedly for black ink than for gray ink. The reason for this is considered that since gray ink has a lower concentration than black ink, that is, gray ink contains a less amount of carbon black than black ink, the degree of the wear caused in the protection layer 405 by carbon black is smaller for gray ink than for black ink.

In view of the above findings, correction is performed to shift an applied driving pulse in accordance with the total driving count of the recording elements 34 included in each recording element array, and the corrected driving pulse is determined to be the driving pulse actually applied to the recording elements 34. During this driving pulse correction processing, correction is actually performed to increase the pulse width of the main pulse of the driving pulse in accordance with the total driving count.

Figure 11A:
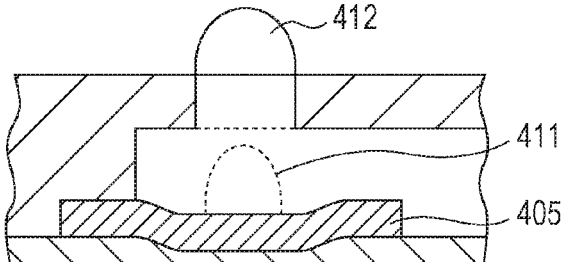
FIGS. 11A to 11C are schematic views for describing a mechanism for reducing the wear of the recording element.
Figure 11B:
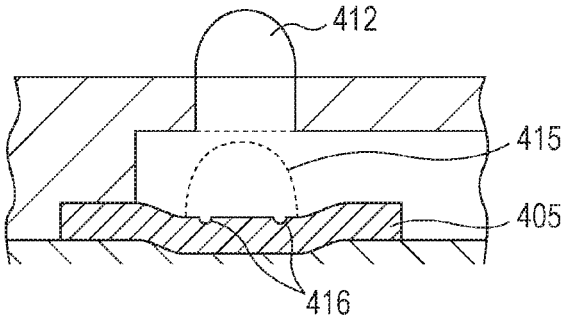
Figure 11C:
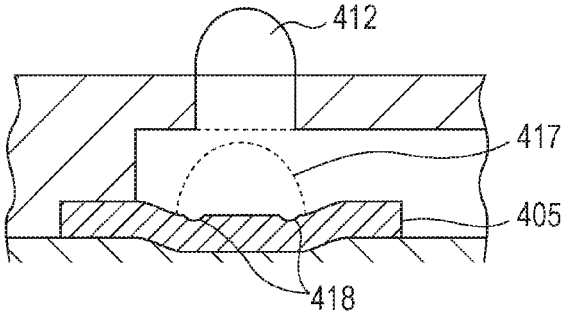

FIGS. 11A to 11C are schematic views for describing an estimated mechanism with which the damage of the recording element 34 is successfully reduced by performing correction processing on a driving pulse in accordance with the total driving count in the first exemplary embedment. FIG. 11A illustrates the same state as the state in FIG. 10A. FIG. 11B is a diagram illustrating the portion near the recording element 34 when correction is performed to increase the pulse width of the main pulse after the driving count has increased to some degree from the state illustrated in FIG. 11A and the corrected driving pulse is applied to the recording element 34. FIG. 11C is a diagram illustrating the portion near the recording element 34 when correction is performed to further increase the pulse width of the main pulse after the driving count has further increased from the state illustrated in FIG. 11B and the corrected driving pulse is applied to the recording element 34.

As described above, wear 416 illustrated in FIG. 11B is caused as the driving count of the recording element 34 increases also in the first exemplary embodiment. Since FIG. 11B illustrates the state after the recording element has been driven the same number of times as that of the state illustrated in FIG. 10B, the degree of the wear 416 is substantially equal to the degree of the wear 413.

In the first exemplary embodiment, correction is performed to increase the pulse width of the main pulse of the driving pulse in the state illustrated in FIG. 11B. Accordingly, the size of a bubble 415 formed after the correction becomes larger than the size of the bubble 411 formed before the correction of the driving pulse.

As illustrated in FIG. 11B, the position of the protection layer 405 that is in contact with the interface between the ink and the bubble 415 changes from the position before the correction of the driving pulse due to the larger bubble 415 and is located at a position shifted from the wear 416.

Accordingly, as illustrated in FIG. 11C, wear 418 may be formed over a wider range than the wear 414 illustrated in FIG. 10C if the driving count of the recording element 34 further increases; however, the wear 418 is not as deep as the wear 414. Thus, it is considered that the performance degradation of the recording element 34 is less likely to occur.

If correction is performed to further increase the pulse width of the main pulse of the driving pulse in the state illustrated in FIG. 11C, a bubble 417 larger than the bubble 415 is formed. Consequently, the position of the protection layer 405 that is in contact with the interface between the ink and the bubble 417 is located at a position shifted from the wear 418, and thus deepening of the wear 418 is successfully suppressed as in the above case.

It is considered that the life of the recording elements 34 is successfully extended by performing correction processing on the driving pulse in accordance with the total driving count of the recording elements 34 in the mechanism described above.

Driving Pulse Control According to First Exemplary Embodiment

Driving pulse control according to the first exemplary embodiment will be described in detail below.

Figure 12:
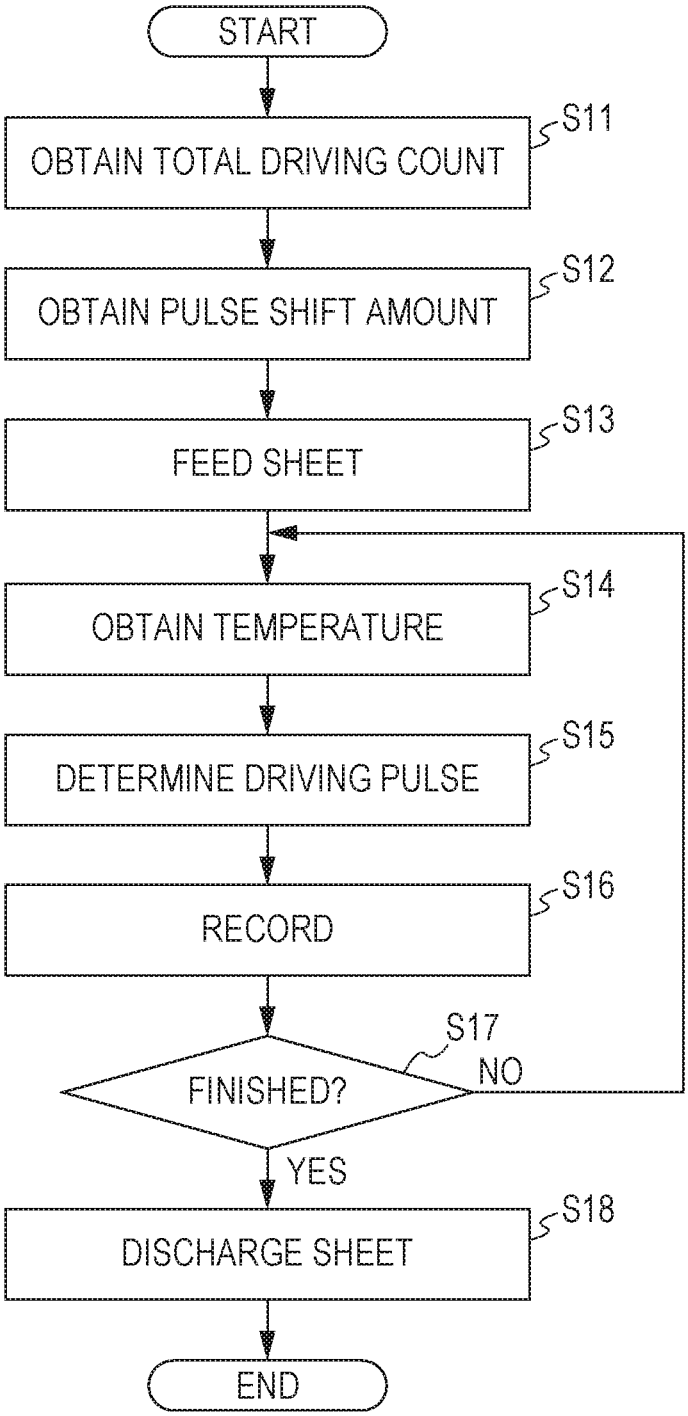
FIG. 12 is a flowchart illustrating driving pulse control according to the first exemplary embodiment.

FIG. 12 is a flowchart of driving pulse control performed by the CPU 101 in accordance with a control program according to the first exemplary embodiment.

In response to input of a recording job for a recording medium, information regarding the total driving count of the recording elements 34 included in each recording element array stored on the EEPROM 122 at that time is obtained in step S11. Specifically, an average driving count per ejection port in each recording element array, which is determined by dividing the total number of times the recording elements 34 included in each recording element array have been driven by the number of ejection ports, is obtained as the information regarding the total driving count described above.

Then, in step S12, an adjustment value (hereinafter, also referred to as a "pulse shift amount") for the pulse width of the main pulse of the driving pulse that is used when recording is performed on the recording medium is obtained by using a different pulse shift table for each recording element array on the basis of the information regarding the total driving count.

FIGS. 13A to 13C are diagrams each illustrating a pulse shift table used in the first exemplary embodiment. FIG. 14 is a diagram indicating which pulse shift table is to be used for each recording element array from among the pulse shift tables illustrated in FIGS. 13A, 13B, and 13C.

As indicated in FIG. 14, a pulse shift table Type A illustrated in FIG. 13A is used for the recording element array 11*x* for black ink in the first exemplary embodiment. In addition, a pulse shift table Type B illustrated in FIG. 13B is used for the recording element array 15*x* for gray ink. Further, a pulse shift table Type C illustrated in FIG. 13C is used for the recording element arrays 12*x* to 14*x* and 16*x* to 18*x* other than the recording element arrays 11*x* and 15*x* respectively for black ink and gray ink.

As indicated in FIG. 13A, the pulse shift table Type A for black ink is configured such that the pulse width of the main pulse is increased by 0.01 μs every time the number of times indicated by the information regarding the total driving count for black ink increases by 50 millions of times (0.5×10^8 times).

For example, when the information regarding the total driving count for black ink indicates 0 times to 50 millions of times (section number "0"), the pulse shift amount is set to 0.00 μs. That is, since the number of times the recording elements 34 for black ink have been driven is small, the pulse width of the main pulse of the driving pulse is not corrected.

When the information regarding the total driving count for black ink indicates 50 millions of times to 100 millions of times (section number "1"), the pulse shift amount is set to 0.01 μs. Since the number of times the recording elements for black ink have been driven has increased to some extent, the position of the interface between the ink and the formed bubble is successfully shifted from the position before correction by slightly increasing the pulse width of the main pulse in this way. The pulse shift table Type A is configured such that the pulse shift amount similarly increases by 0.01 μs every time the number of times indicated by the information regarding the total driving count for black ink increases by 50 millions of times.

As indicated in FIG. 13B, the pulse shift table Type B for gray ink is configured such that the pulse width of the main pulse increases by 0.01 μs every time the number of times indicated by the information regarding the total driving count for gray ink increases by 100 millions of times (1.0×10^8 times).

The number of times indicated by the information regarding the total driving count for gray ink that is needed to increase the pulse shift amount by 0.01 μs in the pulse shift table Type B for gray ink illustrated in FIG. 13B is twice as many as the number of times in the pulse shift table Type A for black ink illustrated in FIG. 13A.

The reason for this is that although wear occurs in the recording element 34 for gray ink as the driving count increases, the degree of the wear is smaller than that of the recording element 34 for black ink since the concentration of carbon black in gray ink is low.

For example, when the driving count for black ink is 50 millions of times to 100 millions of times (section number "1"), the pulse shift amount is set to 0.01 μs in the pulse shift table Type A for black ink. In contrast, when the driving count for gray ink is 50 millions of times to 100 millions of times (section "1"), the pulse shift amount is set to 0.00 μs in the pulse shift table Type B for gray ink. The reason for this is that wear is caused to some extent when the driving count is 50 millions of times to 100 millions of times since the concentration of carbon black in black ink is relatively high, whereas wear is not caused to that extent when the driving count is 50 millions of times to 100 millions of times since the concentration of carbon black in gray ink is relatively low.

As illustrated in FIG. 13C, the pulse shift amount of 0.00 μs is set regardless of the information regarding the total driving count for each ink in the pulse shift table Type C for inks other than black ink and gray ink. The reason for this is that since wear rarely occurs in the recording element 34 for the inks not containing carbon black, which is the cause of the wear, and there is no need to correct the driving pulse. The pulse shift table Type C in which the pulse shift amount of 0.00 μs is set is used in the description here; however, a configuration may be made such that driving pulse correction processing (described below) is not performed for inks other than black ink and gray ink instead of using such a table.

Figure 15:
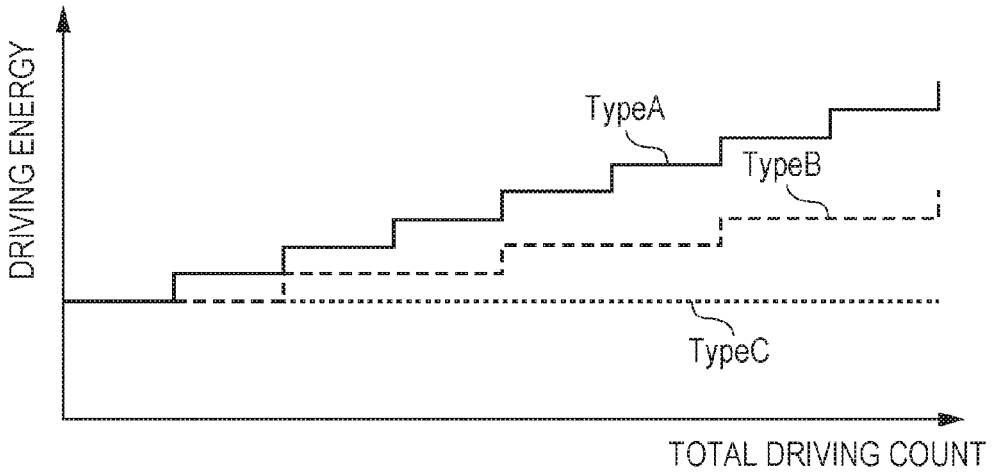
FIG. 15 is a schematic view illustrating a correlation between the total driving count and driving energy.

FIG. 15 is a diagram schematically illustrating a change in driving energy in response to an increase in the driving count of the recording element 34 when the pulse shift tables Type A, Type B, and Type C respectively illustrated in FIGS. 13A, 13B, and 13C are used.

As indicated in FIG. 15, the driving energy is increased relatively fast in the pulse shift table Type A in the first exemplary embodiment since wear is more likely to occur for black ink. In addition, the driving energy is increased more slowly in the pulse shift table Type B than in the pulse shift table Type A since the wear is less likely to occur for gray ink. Further, the driving energy is not changed in the pulse shift table Type C since the wear rarely occurs for inks other than black ink and gray ink. This configuration can slow down the performance degradation of the recording elements 34 included in the recording element arrays for black ink and gray ink.

The pulse shift amount for the recording element arrays for black ink and gray ink are changed by 0.01 μs, which is a relatively small value, in accordance with the driving count in this description. The relatively small value is used to reduce unevenness caused between recording media. The pulse width of the main pulse also influences the amount of ejected ink. Thus, if the pulse shift amount is changed after recording on a certain recording medium and before recording on a subsequent recording medium, the amount of ejected ink changes between the two recording media in response to the change in the pulse shift amount, possibly causing unevenness between the recording media. In view of this possibility, the pulse shift amount is minimized to make unevenness between the recording media less conspicuous even if such unevenness is caused.

After the pulse shift amount is determined for each recording element array in the above-described manner in step S12, a recording medium is fed in step S13.

Then, in step S14, the temperature at each recording element array is obtained from the diode sensors associated with the recording element array.

Then, in step S15, the driving pulse to be applied to the recording elements 34 is determined. Specifically, one driving pulse is temporarily determined for each recording element array on the basis of the temperature at the recording element array obtained in step S14 and the driving pulse table illustrated in FIG. 8B. Then, the driving pulse temporarily determined for each recording element array is corrected by the pulse shift amount obtained for the recording element array in step S12. In this way, the driving pulse to be actually applied to each recording element array is determined.

Then, in step S16, the driving pulses determined in step S15 are applied to the recording elements of the respective recording element arrays to drive the recording elements, so that ink is ejected and recording is performed.

Then, it is determined whether recording has finished in step S17 at intervals of 5.0 μs. If it is determined that recording has not finished, the process returns to step S14 and the similar control is sequentially performed until recording finishes. If it is determined that recording has finished, the recording medium is discharged in step S18, and recording on the recording medium finishes.

As described above, recording is successfully performed while extending the life of the recording head 9 in the first exemplary embodiment.

First Modification

A first modification of the first exemplary embodiment will be described in detail below.

The pulse shift tables Type A, Type B, and Type C respectively illustrated in FIGS. 13A, 13B, and 13C are replaced with pulse shift tables Type A', Type B', and Type C' respectively illustrated in FIGS. 16A, 16B, and 16C, and the pulse shift tables Type A', Type B', and Type C' are used in the first modification. The configuration other than the pulse shift tables is substantially the same as that of the first exemplary embodiment.

In the first exemplary embodiment, the pulse shift amount is increased by 0.01 μs every time the total driving count increases by 50 millions of times for black ink and by 100 millions of times for gray ink since driving of the recording elements has been started.

In contrast, in the first medication, the pulse shift amount is set to 0.00 μs and the driving pulse is not corrected even for black ink and gray ink until the driving count reaches 200 millions of times since driving of the recording elements has been started. After the driving count exceeds 200 millions of times, the pulse shift amount is increased by 0.01 μs every time the driving count increases by 50 millions of times for black ink and by 100 millions of times for gray ink.

The wear of the recording elements does not necessarily occur substantially at a constant speed as the driving count of the recording elements increases. For example, since almost no wear is present on the surface of each recording element soon after driving of the recording element has been started, the speed of wear is slow; however, the wear speed may increase after the wear is caused to some extent.

In view of such a case, the driving pulse is not corrected in the first modification until the wear is caused to some extent, that is, until the driving count exceeds 200 millions of times. Then, after the wear has been caused to some extent and the speed of wear of the recording element has increased, the driving pulse correction processing similar to that of the first exemplary embodiment is performed.

Figure 17:
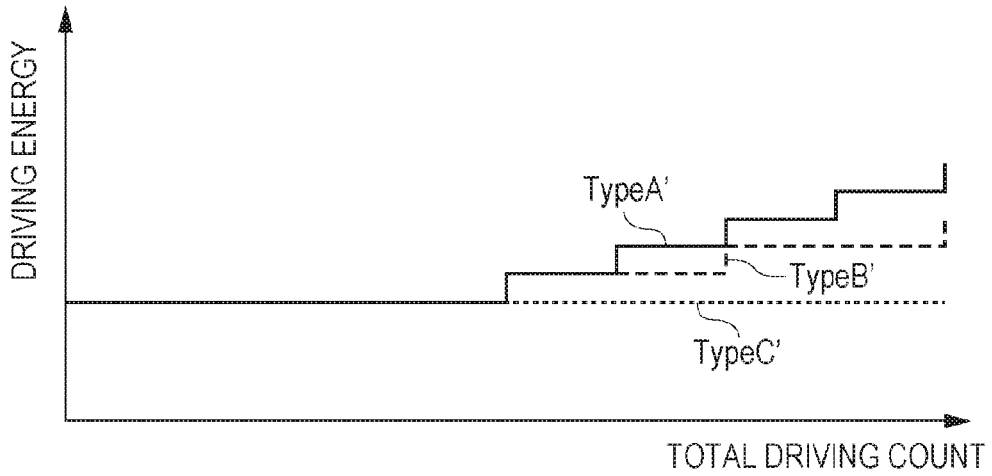
FIG. 17 is a schematic view illustrating a correlation between the total driving count and driving energy.

FIG. 17 is a diagram schematically illustrating a change in driving energy in response to an increase in the total driving count of the recording elements when the pulse shift tables Table A', Table B', and Table C' respectively illustrated in FIGS. 16A, 16B, and 16C are used.

As illustrated in FIG. 17, the driving energy is not increased in the pulse shift tables Type A', Type B', and Type C' until the total driving count increases to some extent in the first modification. After the total driving count has increased to some extent, the driving energy is increased relatively fast in the pulse shift table Type A' and relatively slowly in the pulse shift table Type B'. Such a configuration can slow down the performance degradation of the recording elements included in the recording element arrays for black ink and gray ink.

Second Modification

A second medication of the first exemplary embodiment will be described in detail below.

The pulse shift tables Type A, Type B, and Type C respectively illustrated in FIGS. 13A, 13B, and 13C are replaced with pulse shift tables Type A", Type B", and Type C" respectively illustrated in FIGS. 18A, 18B, and 18C, and the pulse shift tables Type A", Type B", and Type C" are used in the second modification. The configuration other than the pulse shift tables is substantially the same as that of the first exemplary embodiment.

In the first exemplary embodiment, a positive value is set as the pulse shift amount so that the pulse width of the main pulse of the driving pulse to be applied to the recording element arrays for black ink and gray ink increases as the total driving count increases.

In contrast, in the second modification, a negative value is set as the pulse shift amount and correction is performed such that the pulse width of the main pulse of the driving pulse decreases. Specifically, the pulse shift amount is decreased by 0.01 μs every time the total driving count for black ink increases by 50 millions of times. In addition, the pulse shift amount is decreased by 0.01 μs every time the total driving count for gray ink increases by 100 millions of times.

As described above, wear of the recording element is caused at a position of the interface between ink and a bubble. Accordingly, the position of the interface between ink and a bubble is successfully shifted also by decreasing the pulse width of the main pulse of the driving pulse to make the formed bubble smaller. With this configuration, the life of the recording elements is successfully extended also by shortening the pulse width of the main pulse of the driving pulse in accordance with the total driving count of the recording elements as in the first exemplary embodiment.

Figure 19:
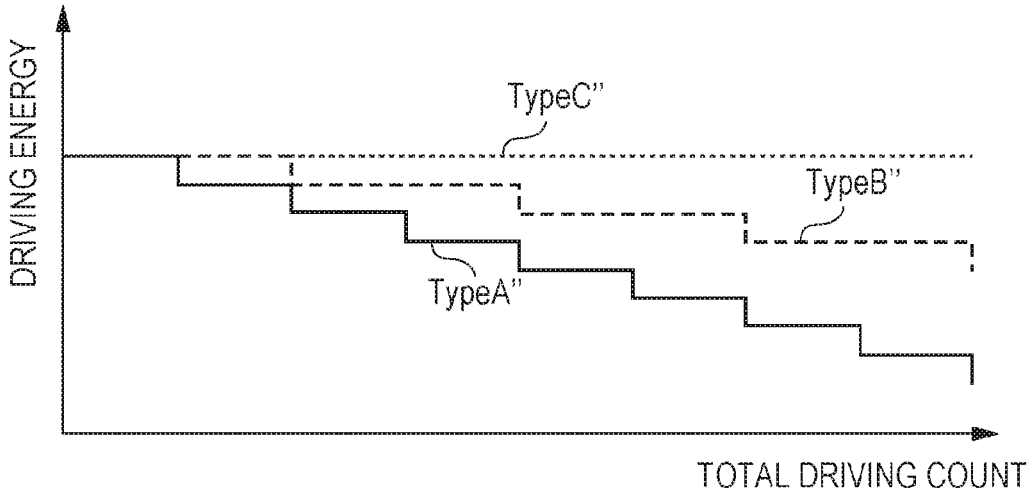
FIG. 19 is a schematic view illustrating a correlation between the total driving count and driving energy.

FIG. 19 is a diagram schematically illustrating a change in driving energy in response to an increase in the total driving count of the recording elements when the pulse shift tables Table A", Table B", and Table C" respectively illustrated in FIGS. 18A, 18B, and 18C are used.

As illustrated in FIG. 19, in the second modification, since wear is more likely to occur for black ink, driving energy is decreased relatively fast in the pulse shift table Type A". In addition, since the wear is less likely to occur for gray ink, the driving energy is decreased more slowly in the pulse shift table Type B" than in the pulse shift table Type A". Further, since the wear rarely occurs for inks other than black ink and gray ink, the driving energy is not changed in the pulse shift table Type C". Such a configuration can also slow down the performance degradation of the recording elements included in the recording element arrays for black ink and gray ink.

Kogation of ink used in the first exemplary embodiment may occur when the recording elements are driven many times, and the kogation may attach to the surface of the recording elements. If kogation attaches the surface of the recording elements in this manner, the amount of ejected ink may decrease or an ejection speed may decrease.

If the pulse width of the main pulse of the driving pulse is decreased in such a state, the driving energy decreases. Consequently, the decrease in the amount of ejected ink and the decrease in the ejection speed may be promoted and may become significant. That is, the second modification can extend the life of the recording elements but may promote degradation of ejection characteristics, such as the amount of ejected ink and the ejection speed, as the driving count increases. In view of this point, correction for increasing the driving energy in accordance with the total driving count as in the first exemplary embodiment is more preferable than correction for decreasing the driving energy in accordance with the total driving count as in the second modification.

Second Exemplary Embodiment

In the first exemplary embodiment described above, the description has been given of the case where the average driving count per ejection port of each recording element array is used as the information regarding the total driving count.

In contrast, in the second exemplary embodiment, a description will be given of the case where the average driving count is divided by a predetermined constant and the remainder obtained by the division is used as the information regarding the total driving count.

Note that a description about the configuration that is substantially the same as that of the first exemplary embodiment described above is omitted.

When the driving pulse is corrected on the basis of the average driving count as in the first exemplary embodiment, the correction is no longer performed after the driving count has reached 400 millions of times (4×10^8 times) if the pulse shift tables Type A, Type B, and Type C respectively illustrated in FIGS. 13A, 13B, and 13C are used, for example. In such a case, the driving pulse is corrected using the same correction value when the recording elements are used thereafter although the recording elements are usable depending on the degree of wear of the recording elements even after they are driven more than 400 millions of times. Accordingly, the same size of bubble is continuously formed, which may decrease the life of the recording elements.

Accordingly, in the second exemplary embodiment, in step S12 in FIG. 12, the number of times indicated by the information regarding the total driving count is divided by a constant K and a remainder Mod obtained by the division is used as the information regarding the total driving count of the recording elements. In the second exemplary embodiment, the constant K is set to 400 millions of times (4×10^8 times).

If the information regarding the total driving count indicates 0 times to 400 millions of times, the remainder obtained by dividing the value by the constant K is the value indicated by the information regarding the total driving count. Accordingly, the pulse shift amount that is the same as that used in the first exemplary embodiment is selected.

In contrast, if the information regarding the total driving count indicates 500 millions of times, the remainder obtained by dividing the value by the constant K is 100 millions of times (1×10^8 times). Accordingly, the same pulse shift amount as that of the case where the information regarding the total driving count indicates 100 millions of times (section number "2") is selected.

As described above, in the second exemplary embodiment, even when the number of times indicated by the information regarding the total driving count has reached the upper limit of the total driving count defined in the pulse shift table, the pulse shift amount is successfully changed instead of being fixed. This configuration can further extend the life of the recording elements.

Figure 20:
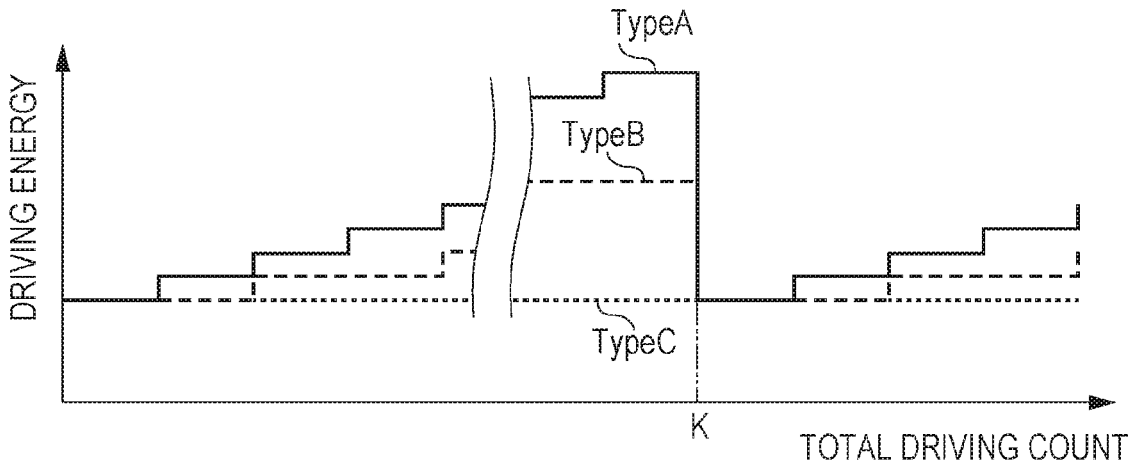
FIG. 20 is a schematic view illustrating a correlation between the total driving count and driving energy.

FIG. 20 is a diagram schematically illustrating a change in driving energy in response to an increase in the total driving count of the recording elements when the pulse shift tables Table A, Table B, and Table C respectively illustrated in FIGS. 13A, 13B, and 13C are used and the above-described remainder is used as the information regarding the total driving count.

As indicated in FIG. 20, the driving energy is successfully increased gradually for black ink and gray ink until the total driving count reaches K times (400 millions of times). Further, after the total driving count has exceeded K times, the driving energy is returned again to the driving energy for the case where the total driving count is 0 times. Thereafter, the driving energy is successfully changed in the same manner as that of the case where the total driving count is 0 times to 400 millions of times.

Accordingly, in the second exemplary embodiment, the life of the recording elements can be further extended even when the total driving count is very large.

Third Exemplary Embodiment

In the first and second exemplary embodiments described above, the description has been given of the case where the pulse shift amount is determined only in accordance with the information regarding the total driving count of the recording elements.

In contrast, in a third exemplary embodiment, a description will be given of the case where the pulse shift amount is increased when color correction processing has been performed as well as when the number of times indicated by the information regarding the total driving count of the recording elements has increased to some extent.

Note that a description about the configuration that is substantially the same as those of the first and second exemplary embodiments described above is omitted.

In the third exemplary embodiment, a test pattern is recorded at each predetermined timing, and the test pattern is scanned using a density sensor included in the inkjet recording apparatus. In this way, a deviation of the actual recording density from a desired recording density is calculated. Then, the color correction parameter used in the γ correction J0004 is changed so that the deviation in the recording density is successfully decreased.

For example, when the actual recording density is higher than the desired recording density, the γ correction is performed using a color correction parameter that decreases the amount of ejected ink from the usual amount of ejected ink. In this way, the deviation in the recording density is successfully decreased.

The following issue occurs when the driving pulse applied to record the test pattern during such color correction processing is used as a driving pulse corrected on the basis of the information regarding the total driving count of the recording elements.

If the number of times indicated by the information regarding the total driving count exceeds any of the thresholds defined in the pulse shift tables illustrated in FIGS. 13A, 13B, and 13C after the color correction processing has been performed and the pulse shift amount changes, the driving pulse used for recording is corrected for the following recording media by using a value different from the pulse shift amount used for the driving pulse applied when the color correction processing has been performed. Thus, a deviation in the recording density may be caused again due to the use of the different pulse shift amount in the following recording even though the color correction processing has been performed.

Accordingly, in the third exemplary embodiment, the information regarding the total driving count is obtained when the color correction processing is performed, and the pulse shift amount obtained by increasing the section number by 1 from the section number associated with the pulse shift amount determined on the basis of the value indicated by the obtained information and one of the pulse shift tables illustrated in FIGS. 13A to 13C is used as the pulse shift amount for the driving pulse when the color correction processing is performed.

For example, when the information regarding the total driving count for black ink indicates 200 millions of times when the color correction processing is performed, the corresponding pulse shift amount is 0.03 μs associated with the section number "3" as illustrated in FIG. 13A. Accordingly, the pulse shift amount used for black ink when the color correction processing is performed is set to 0.04 μs associated with the section number "4" which is increased by 1 from the second number "3". The pulse shift amount thus obtained and used in the color correction processing is stored on the RAM 103.

In the third exemplary embodiment, in step S12 illustrated in FIG. 12, the pulse shift amount obtained on the basis of the information regarding the total driving count obtained in step S11 and one of the pulse shift tables illustrated in FIGS. 13A to 13C is compared with the pulse shift amount stored on the RAM 103 when the color correction processing has been performed last time, and the larger pulse shift amount of these pulse shift amounts is used as the pulse shift amount during the subsequent recording.

Specifically, when the color correction processing has not been performed since the section number corresponding to the information regarding the total driving count has changed last time, the pulse shift amount obtained in step S12 is larger than the pulse shift amount stored during the last color correction processing. Thus, the driving pulse is corrected by using the pulse shift amount obtained in step S12 as in the first exemplary embodiment.

On the other hand, when the color correction processing has been performed since the section number corresponding to the information regarding the total driving count has changed last time, the pulse shift amount for the section number which is larger than the section number of the pulse shift amount that has been used for recording by "1" is stored on the RAM 103. Accordingly, since the pulse shift amount stored during the last color correction processing is equal to or larger than the pulse shift amount obtained in step S12, the driving pulse is corrected by using the pulse shift amount associated with the next section number at this timing even if the information regarding the total driving count does not exceeds the next threshold. The reason for this is as follows. Although there is no need to change the pulse shift amount in view of the wear of the recording elements, the pulse shift amount is desirably changed in order to suppress the deviation in the recording density since the color correction processing is performed by using the driving pulse corrected by the pulse shift amount associated with the next section number.

Figure 21:
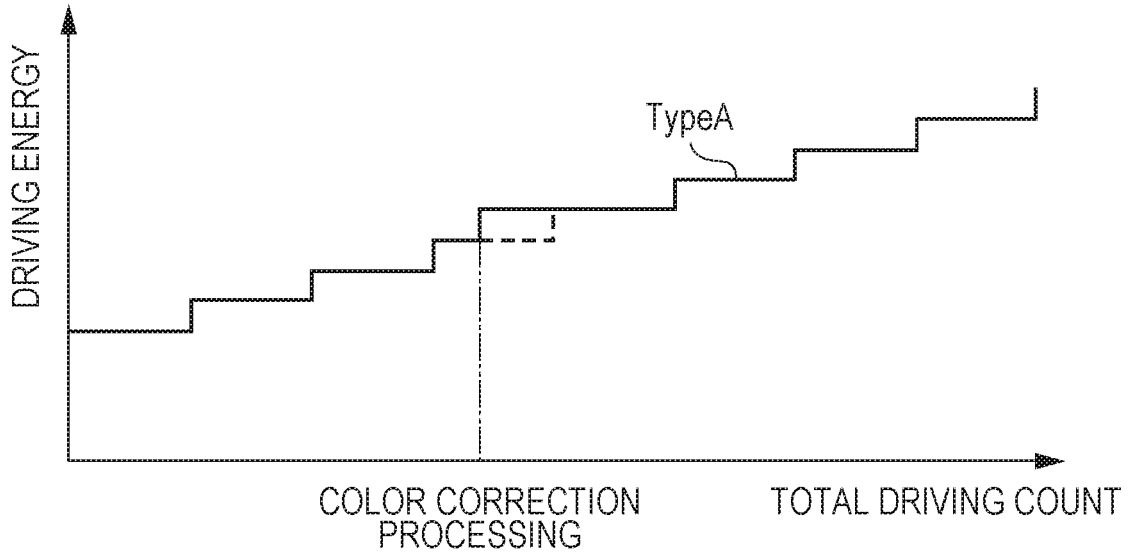
FIG. 21 is a schematic view illustrating a correlation between the total driving count and driving energy.

FIG. 21 is a diagram schematically illustrating a change in driving energy in response to an increase in the total driving count of the recording elements when the pulse shift table Type A illustrated in FIG. 13A is used and the color correction processing is performed at a certain timing in the third exemplary embodiment. In FIG. 21, a solid line represents how the driving energy changes in the third exemplary embodiment, whereas a dashed line represents how the driving energy changes in the first exemplary embodiment. In addition, a dotted-dashed line represents the timing at which the color correction processing is performed.

As illustrated in FIG. 21, the driving energy changes in the same manner in the third exemplary embodiment as in the first exemplary embodiment until the color correction processing is performed.

However, when the color correction processing is performed at the illustrated timing, the pulse shift amount associated with the section number increased by 1 is stored on the RAM 103 at that timing. Accordingly, when recording is performed on a recording medium immediately after the color correction processing has been performed, the pulse shift amount associated with the section number increased by 1 from the previous section number is used. Thus, when the color correction processing is performed, the pulse shift amount is changed to the pulse shift amount associated with the next section number at an earlier timing than that of the first exemplary embodiment, and the driving energy is increased earlier.

With such a configuration, the life of the recording elements can be extended and the deviation in the recording density due to the color correction processing can be appropriately suppressed in the third exemplary embodiment.

Other Embodiments

Embodiment(s) of the disclosure can be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the exemplary embodiments above, the description has been given of the case of recording an image by performing scanning a plurality of times for a recording medium; however, the image may be recorded in another way. For example, the driving pulse control according to each exemplary embodiment is applicable to a recording apparatus that records an image by using a long recording head having a length longer than the length in the width direction of the recording medium and by ejecting ink from the recording head while conveying the recording medium in a direction perpendicular to the width direction only once.

In the exemplary embodiments above, the description has been given of the case where the number of times the recording elements have been driven is counted by the counters and the information regarding the total driving count of the recording elements is determined on the basis of the result; however, the information may be determined in another way. For example, the information regarding the total driving count of the recording elements may be determined on the basis of an amount of ink used and the number of recording media used for recording.

An inkjet recording apparatus and an inkjet recording method according to aspects of the embodiments enable recording to be performed while extending the life of the recording head.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-193492, filed Sep. 30, 2015, which is hereby incorporated by reference herein in its entirety.

What is claimed is:

1. An inkjet recording apparatus that records an image by ejecting ink onto a recording medium, comprising:

a recording head including a first recording element array and a second recording element array, the first recording element array in which a plurality of recording elements configured to produce thermal energy used to eject ink of a first color are arranged, the second recording element array in which a plurality of recording elements configured to produce thermal energy used to eject ink of a second color different from the first color are arranged;

a first obtaining unit configured to, for each of the first and second recording element arrays, obtain first information, the first information being information regarding a total number of times the plurality of recording elements included in the corresponding one of the first and second recording element arrays have been driven since attachment of the recording head to the inkjet recording apparatus;

a determining unit configured to, for each of the first and second recording element arrays, determine a driving pulse to be applied to the plurality of recording elements included in the corresponding one of the first and second recording element arrays on the basis of the first information; and a controller configured to, for each of the first and second recording element arrays, control driving of the plurality of recording elements included in the corresponding one of the first and second recording element arrays so as to eject the ink by applying the driving pulse determined by the determining unit to the plurality of recording elements included in the corresponding one of the first and second recording element arrays, wherein the determining unit determines, (i-1) when the total number of times indicated by the first information for the first recording element array is a first value, a first driving pulse as the driving pulse to be applied to the first recording element array, (i-2) when the total number of times indicated by the first information for the first recording element array is a second value larger than the first value, a second driving pulse as the driving pulse to be applied to the first recording element array, the second diving pulse having a pulse width different from that of the first driving pulse, (ii-1) when the total number of times indicated by the first information for the second recording element array is the first value, a third driving pulse as the driving pulse to be applied to the second recording element array, and (ii-2) when the total number of times indicated by the first information for the second recording element array is the second value, a fourth driving pulse as the driving pulse to be applied to the second recording element array, the fourth driving pulse having a pulse width different from that of the second driving pulse and that of the third driving pulse.

2. The inkjet recording apparatus according to claim 1, wherein the determining unit determines, (i-1) when the total number of times indicated by the first information for the first recording element array is smaller than a first threshold, the first driving pulse as the driving pulse to be applied to the first recording element array, (i-2) when the total number of times indicated by the first information for the first recording element array is larger than the first threshold, the second driving pulse as the driving pulse to be applied to the first recording element array, (ii-1) when the total number of times indicated by the first information for the second recording element array is smaller than a second threshold, the third driving pulse as the driving pulse to be applied to the second recording element array, and (ii-2) when the total number of times indicated by the first information for the second recording element array is larger than the second threshold, the fourth driving pulse as the driving pulse to be applied to the second recording element array, and wherein each of the first threshold and the second threshold is larger than the first value and is smaller than the second value.

3. The inkjet recording apparatus according to claim 1, wherein the pulse width of the first driving pulse and the pulse width of the third driving pulse are equal to each other.

4. The inkjet recording apparatus according to claim 1, further comprising:

a second obtaining unit configured to obtain second information, the second information being information regarding temperature of the recording head during a recording operation; and a memory configured to store a driving pulse table that defines a plurality of driving pulses and includes correspondences between the temperature and the plurality of driving pulses, each of the plurality of driving pulses including a main pulse and a pre-pulse to be applied to the plurality of recording elements prior to the main pulse, the pre-pulses of the plurality of driving pulses having pulse widths different from one another, wherein the determining unit includes a first determining unit configured to determine a driving pulse from among the plurality of driving pulses on the basis of the second information and the driving pulse table, a second determining unit configured to, for each of the first and second recording element arrays, determine an adjustment value used to adjust a pulse width of the driving pulse for the corresponding one of the first and second recording element arrays on the basis of the first information for the corresponding one of the first and second recording element arrays, and a third determining unit configured to, for each of the first and second recording element arrays, determine the driving pulse to be applied to the plurality of recording elements included in the corresponding one of the first and second recording element arrays by adjusting the driving pulse determined by the first determining unit on the basis of the adjustment value determined by the second determining unit for the corresponding one of the first and second recording element arrays.

5. The inkjet recording apparatus according to claim 4, wherein the third determining unit, for each of the first and second recording element arrays, determines the driving pulse to be applied to the plurality of recording elements included in the corresponding one of the first and second recording element arrays by adjusting a pulse width of the main pulse of the driving pulse determined by the first determining unit to increase in accordance with the adjustment value determined by the second determining unit for the corresponding one of the first and second recording element arrays.

6. The inkjet recording apparatus according to claim 4, wherein the second determining unit determines, (i-1) when the total number of times indicated by the first information for the first recording element array is the first value, a first adjustment value as the adjustment value used to adjust the pulse width of the driving pulse for the first recording element array, (i-2) when the total number of times indicated by the first information for the first recording element array is the second value, a second adjustment value larger than the first adjustment value as the adjustment value used to adjust the pulse width of the driving pulse for the first recording element array, (ii-1) when the total number of times indicated by the first information for the second recording element array is the first value, a third adjustment value as the adjustment value used to adjust the pulse width of the driving pulse for the second recording element array, and (ii-2) when the total number of times indicated by the first information for the second recording element array is the second value, a fourth adjustment value as the adjustment value used to adjust the pulse width of the driving pulse for the second recording element array, the fourth adjustment value being larger than the third adjustment value and different from the second adjustment value.

7. The inkjet recording apparatus according to claim 6, wherein the first adjustment value and the third adjustment value are equal to each other.

8. The inkjet recording apparatus according to claim 7, wherein the first adjustment value and the third adjustment value are equal to 0.

9. The inkjet recording apparatus according to claim 4, wherein the second determining unit determines the adjustment value after recording is finished on a first recording medium that is the recording medium and before subsequent recording is started on a second recording medium that is the recording medium following the first recording medium.

10. The inkjet recording apparatus according to claim 4, wherein the first determining unit determines, (i) when the temperature indicated by the second information is a first temperature, a driving pulse including a pre-pulse having a first pulse width as the driving pulse, and (ii) when the temperature indicated by the second information is a second temperature higher than the first temperature, a driving pulse including a pre-pulse having a second pulse width shorter than the first pulse width as the driving pulse.

11. The inkjet recording apparatus according to claim 1, wherein the ink of the first color is ink containing carbon black at a first concentration, and the ink of the second color is ink containing carbon black at a second concentration lower than the first concentration, and wherein the pulse width of the second driving pulse is longer than the pulse width of the fourth driving pulse.

12. The inkjet recording apparatus according to claim 1, wherein the ink of the first color is ink containing carbon black, and the ink of the second color is ink not containing carbon black, and wherein the pulse width of the second driving pulse is longer than the pulse width of the fourth driving pulse.

13. The inkjet recording apparatus according to claim 1, further comprising:

a third obtaining unit configured to obtain image data corresponding to the image to be recorded on the recording medium and represented in values corresponding to colors of inks;

a fourth obtaining unit configured to obtain a color correction parameter used in color correction performed on the image data at each predetermined timing;

a first generating unit configured to generate correction data by performing color correction on the image data obtained by the third obtaining unit by using the color correction parameter obtained by the fourth obtaining unit; and a second generating unit configured to generate, on the basis of the correction data generated by the first generating unit, recording data represented in values corresponding to colors of inks used in the driving control of the plurality of recording elements performed by the controller, wherein the determining unit determines, (i-1) when the total number of times indicated by the first information for the first recording element array is the first value and the color correction parameter is not obtained by the fourth obtaining unit, the first driving pulse as the driving pulse to be applied to the first recording element array, (i-2) when the total number of times indicated by the first information for the first recording element array is the first value and the color correction parameter is obtained by the fourth obtaining unit, the second driving pulse as the driving pulse to be applied to the first recording element array, and (i-3) when the total number of times indicated by the first information for the first recording element array is the second value, the second driving pulse as the driving pulse to be applied to the first recording element array.

14. The inkjet recording apparatus according to claim 13, further comprising:

a test pattern recording unit configured to record a test pattern; and a fifth obtaining unit configured to obtain a scan result of the test pattern recorded by the test pattern recording unit, wherein the fourth obtaining unit obtains the color correction parameter on the basis of the scan result of the test pattern obtained by the fifth obtaining unit, and wherein the test pattern recording unit records the test pattern by applying the second driving pulse to the plurality of recording elements included in the first recording element array.

15. The inkjet recording apparatus according to claim 1, wherein the recording elements are covered with protect layers.

16. The inkjet recording apparatus according to claim 1, wherein the recording elements produce thermal energy to generate bubble.

17. An inkjet recording apparatus that records an image by ejecting ink onto a recording medium, comprising:

a recording head including bubble formation chambers in which bubble is formed for ejecting ink, and a recording element array in which a plurality of recording elements, which are covered with protect layers and configured to produce thermal energy to generate bubble, are arranged;

a first obtaining unit configured to obtain first information, the first information being information regarding a total number of times the plurality of recording elements included in the recording element array have been driven since attachment of the recording head to the inkjet recording apparatus;

a determining unit configured to determine a driving pulse to be applied to the plurality of recording elements included in the recording element array on the basis of the first information; and a controller configured to control driving of the plurality of recording elements by applying the driving pulse determined by the determining unit to the plurality of recording elements to give the thermal energy to the ink, change a state of the ink, and form a bubble in the ink so that the ink is ejected by pressure caused by the formed bubble, wherein the determining unit determines, (i) when the total number of times indicated by the first information is a first value, a first driving pulse as the driving pulse to be applied to the plurality of recording elements, and (ii) when the total number of times indicated by the first information is a second value larger than the first value, a second driving pulse different from the first driving pulse as the driving pulse to be applied to the plurality of recording elements, and wherein a position where the bubble in the bubble chamber contacts with the protect layer in a case where the first driving pulse is applied to the plurality of recording elements when the total number of times is the first value is different from a position where the bubble in the bubble chamber contacts with the protect layer in a case where the second driving pulse is applied to the plurality of recording elements when the total number of times is the second value.

18. The inkjet recording apparatus according to claim 17, wherein a size of the bubble in the bubble chamber in a case where the first driving pulse is applied to the plurality of recording elements when the total number of times is the first value is smaller than a size of bubble in the bubble chamber in a case where the second driving pulse is applied to the plurality of recording elements when the total number of times is the second value.

19. The inkjet recording apparatus according to claim 17, wherein a size of the bubble in the bubble chamber in a case where the first driving pulse is applied to the plurality of recording elements when the total number of times is the first value is larger than a size of bubble in the bubble chamber in a case where the second driving pulse is applied to the plurality of recording elements when the total number of times is the second value.

20. An inkjet recording method for recording an image by ejecting ink onto a recording medium by using a recording head including a first recording element array and a second recording element array, the first recording element array in which a plurality of recording elements configured to produce thermal energy used to eject ink of a first color are arranged, the second recording element array in which a plurality of recording elements configured to produce thermal energy used to eject ink of a second color different from the first color are arranged, the inkjet recording method comprising:

a first obtaining step of obtaining, for each of the first and second recording element arrays, first information, the first information being information regarding a total number of times the plurality of recording elements included in the corresponding one of the first and second recording element arrays have been driven since attachment of the recording head to an inkjet recording apparatus;

a determining step of determining, for each of the first and second recording element arrays, a driving pulse to be applied to the plurality of recording elements included in the corresponding one of the first and second recording element arrays on the basis of the first information; and a control step of controlling, for each of the first and second recording element arrays, driving of the plurality of recording elements included in the corresponding one of the first and second recording element arrays so as to eject the ink by applying the driving pulse determined in the determining step to the plurality of recording elements included in the corresponding one of the first and second recording element arrays, wherein in the determining step, (i-1) when the total number of times indicated by the first information for the first recording element array is a first value, a first driving pulse is determined as the driving pulse to be applied to the first recording element array, (i-2) when the total number of times indicated by the first information for the first recording element array is a second value larger than the first value, a second driving pulse is determined as the driving pulse to be applied to the first recording element array, the second diving pulse having a pulse width different from that of the first driving pulse, (ii-1) when the total number of times indicated by the first information for the second recording element array is the first value, a third driving pulse is determined as the driving pulse to be applied to the second recording element array, and (ii-2) when the total number of times indicated by the first information for the second recording element array is the second value, a fourth driving pulse is determined as the driving pulse to be applied to the second recording element array, the fourth driving pulse having a pulse width different from that of the second driving pulse and that of the third driving pulse.

* * * * *